United States Patent [19]

Grantham

[11] 4,159,632

[45] Jul. 3, 1979

[54] AUTOMATIC CLEANING APPARATUS

[76] Inventor: Frederick W. Grantham, 12055 Goshen Ave., Los Angeles, Calif. 90066

[21] Appl. No.: 743,965

[22] Filed: Nov. 22, 1976

[51] Int. Cl.[2] ..... D06F 15/00

[52] U.S. Cl. ..... 68/9; 68/13 R; 68/22 R; 68/27; 68/51; 68/124; 68/125; 68/158; 68/183; 68/184; 68/195; 68/196; 68/208; 68/210; 68/216; 68/270; 271/258

[58] Field of Search ..... 68/9, 43, 51, 53, 157, 68/158, 183, 184, 190, 22 R, 122, 115, 116, 124, 45, 216, 217, 210, 212, 270, 195, 196, 15, 27, 208, 207, 13 R, 20; 416/64, 65; 271/258

[56] References Cited

U.S. PATENT DOCUMENTS

| | | | |
|---|---|---|---|
| 206,489 | 7/1878 | Sargent | 68/22 R |
| 223,167 | 12/1879 | Rea | 68/216 |
| 260,900 | 7/1882 | Sargent et al. | 68/210 |
| 291,089 | 1/1884 | Sargent et al. | 68/158 X |
| 558,305 | 4/1896 | Peckham | 68/51 X |
| 896,563 | 8/1908 | Miller | 68/124 X |
| 1,027,363 | 5/1912 | Valentine | 68/270 |
| 1,360,464 | 11/1920 | Stults | 68/158 X |
| 1,525,946 | 2/1925 | Mellor | 68/51 |
| 1,783,407 | 12/1930 | Conway et al. | 68/158 X |
| 2,013,522 | 9/1935 | Mills | 68/158 X |
| 2,850,025 | 9/1958 | Bond | 68/196 X |
| 3,344,626 | 10/1967 | Spangler | 68/122 |
| 3,693,382 | 9/1972 | Grantham | 68/158 X |
| 3,771,333 | 11/1973 | Jurjans | 68/207 X |

FOREIGN PATENT DOCUMENTS

| | | | |
|---|---|---|---|
| 5599 | 6/1932 | Australia | 68/158 |
| 467128 | 8/1950 | Canada | 68/158 |
| 831537 | 2/1952 | Fed. Rep. of Germany | 68/20 |
| 899187 | 12/1953 | Fed. Rep. of Germany | 68/43 |
| 196767 | 5/1923 | United Kingdom | 68/43 |
| 209240 | 1/1924 | United Kingdom | 68/51 |
| 531699 | 1/1941 | United Kingdom | 68/183 |

*Primary Examiner*—Philip R. Coe
*Attorney, Agent, or Firm*—Henry M. Bissell

[57] ABSTRACT

A unit for automatically cleaning items such as laundry or the like comprises a plurality of reciprocating plungers mounted to engage the items within a tank containing the items and a cleaning liquid. Each plunger comprises a piston mounted within a canister. The piston is mounted within the canister in an arrangement which permits a limited relative movement between the piston and canister, thus developing a bi-directional pumping action. With each stroke of the plunger, the piston forces liquid through the items to be cleaned, first in one direction and then the other, by virtue of the limited movement of the piston relative to the canister, the latter serving to assist in holding the items to be cleaned in a position for encountering the liquid being driven by the piston. The combined rotary reciprocating action of the plungers not only serves to clean the items in the tank but also to slowly propel them from the inlet to the outlet end of the tank so that a continuous cleaning process is performed. Additional propulsion means are provided for acceleration of the laundry items, as desired. A plurality of units may be situated in sequence together with associated equipment for monitoring, controlling and operating the various processing steps in a complete automatic cleaning system.

28 Claims, 28 Drawing Figures

AUTOMATIC CLEANING APPARATUS

BACKGROUND OF THE INVENTION

1. Field of the Invention

The present invention relates to automatic cleaning apparatus, and more particularly, to such apparatus of the continuous processing type, such as is customarily employed in large scale institutional operations.

2. Description of the Prior Art

Particular problems not ordinarily associated with home laundry operations are encountered in institutional laundering. Although the major proportion of items requiring cleaning are amenable to laundering, it will be understood that the term laundering is used herein in its broad sense and includes not only washing and the various operations directly associated therewith, such as bleaching and rinsing, but also includes dry cleaning and associated operations. Because of the large volume of articles to be laundered (or dry cleaned) in large institutions such as hospitals, schools, military bases, prisons and the like, the laundry equipment must be highly automated, must be capable of substantially continuous use without breakdown, must be simple to operate, and must be competitive in price with existing available equipment. In such operations, the cost of labor involved in operating the equipment is a significant factor in the operating cost and in the selection of the equipment to be used. Similarly, the equipment itself is generally so expensive that down-time or interruption of the operating process of the equipment is generally to be avoided or minimized. These and other factors have militated toward the design of continuous processing laundering apparatus in which the dirty laundry is inserted at one end and the laundering process proceeds on a continuous basis with the clean laundry being removed at the opposite end. Sometimes such continuous laundry apparatus is used on conjunction with drying equipment of a similar continuous flow-through design.

Most of the automatic laundry equipment of the continuous operating type, such as is utilized in institutional or commercial laundries in this country, is of the rotating drum type. These are very large and expensive machines, constructed mainly of stainless steel or other materials not subject to corrosion and require substantial quantities of water and chemicals used in the washing process. Their cost and size are such that only the larger institutional and commercial laundries can justify their purchase and use.

An improved, continuous-flow laundry apparatus of another type, utilizing a peristaltic pumping action is the subject of my U.S. Pat. No. 3,693,382. While less expensive to manufacture than the drum type, stainless steel units referred to hereinabove, the cost of such equipment is such that additional improvements are continually being sought and are desirable in this competitive field.

SUMMARY OF THE INVENTION

Automatic cleaning apparatus in accordance with the present invention comprises at least one tank adapted for containing a cleaning liquid and the items to be cleaned. Hereinafter, apparatus in accordance with the invention will be referred to as continuous washing apparatus in the context of an automatic laundry system. However, it will be understood that such arrangements encompass other processes as may be applicable, such as dry cleaning, dyeing, and the like.

The tank of the present apparatus has a generally open top portion, agitating means in the form of a series of plungers disposed at least partially within the tank and adapted for agitating the liquid and laundry items contained therein, and reciprocating means mounted externally of the tank and connected to the agitating means for causing reciprocating movement of at least portions thereof.

In accordance with an aspect of the invention, the plungers are preferably formed with an internal piston mounted for longitudinal movement within an outer canister. The canister is provided with a perforated bottom and a protective skirt extending below the bottom in a bell-shaped configuration. The top of the canister is generally closed except in the center through which a connecting rod extends between the top of the internal piston and associated drive means. The piston is positively driven in a vertical reciprocating motion and the canister moves up and down relative to the piston as constrained by the resistance of the liquid and the force of respective compression springs mounted on the connecting rod above and below the upper end of the canister.

The tank of the present apparatus has a perforated horizontal divider or false bottom mounted in the lower portion of the tank and laundry items are driven against this bottom by the movement of the plungers toward the lower limit of their travel. The movement of the piston inside the canister develops a flow of water from the bottom of the canister through the laundry items and through the perforated false bottom on the downward stroke. On the following upward stroke, the upward movement of the piston relative to the canister develops a reverse flow of liquid through the laundry items as they are drawn upward against the perforated bottom of the cannister. The bi-directional forced flow of liquid through the laundry items is very effective in loosening and removing soil and cleaning and otherwise processing the items.

In accordance with an aspect of the invention, the reciprocating plungers are driven by crank members at the upper end of the respective connecting rods so that the effect on the laundry items in the tank is to direct them from the inlet toward the outlet end, where they may be removed after their traversal of the tank by suitable conveyor apparatus. In particular embodiments of the present invention, arrangements are provided for enhancing the lateral movement of the plungers so as to expedite the travel of the laundry items through the laundry tank. In addition, in one particular arrangement, a positive drive mechanism including an actuator and a slidable bladed member is provided to positively drive the laundry items toward the exit end of the tank.

Arrangements in accordance with the present invention may incorporate a plurality of tank and plunger units to provide a large-capacity, fully automatic, flow-through laundry system. An alternative embodiment is also disclosed for a small-capacity, repetitive batch laundry system utilizing a single tank and plunger unit with arrangements for introducing and removing the various liquids in succession which are used for processing the laundry goods.

In the preferred system in accordance with the invention, various control devices and circuitry are incorporated in conjunction with the respective units comprising the individual tank and plunger apparatus so that a completely automatic, flow-through laundry system is provided. The system is simpler to construct and operate, is more economical to manufacture and maintain, and is more economical of liquids and chemicals employed in the laundry process than those automatic, flow-through laundry systems which are presently on the market.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENT

Figure 1:
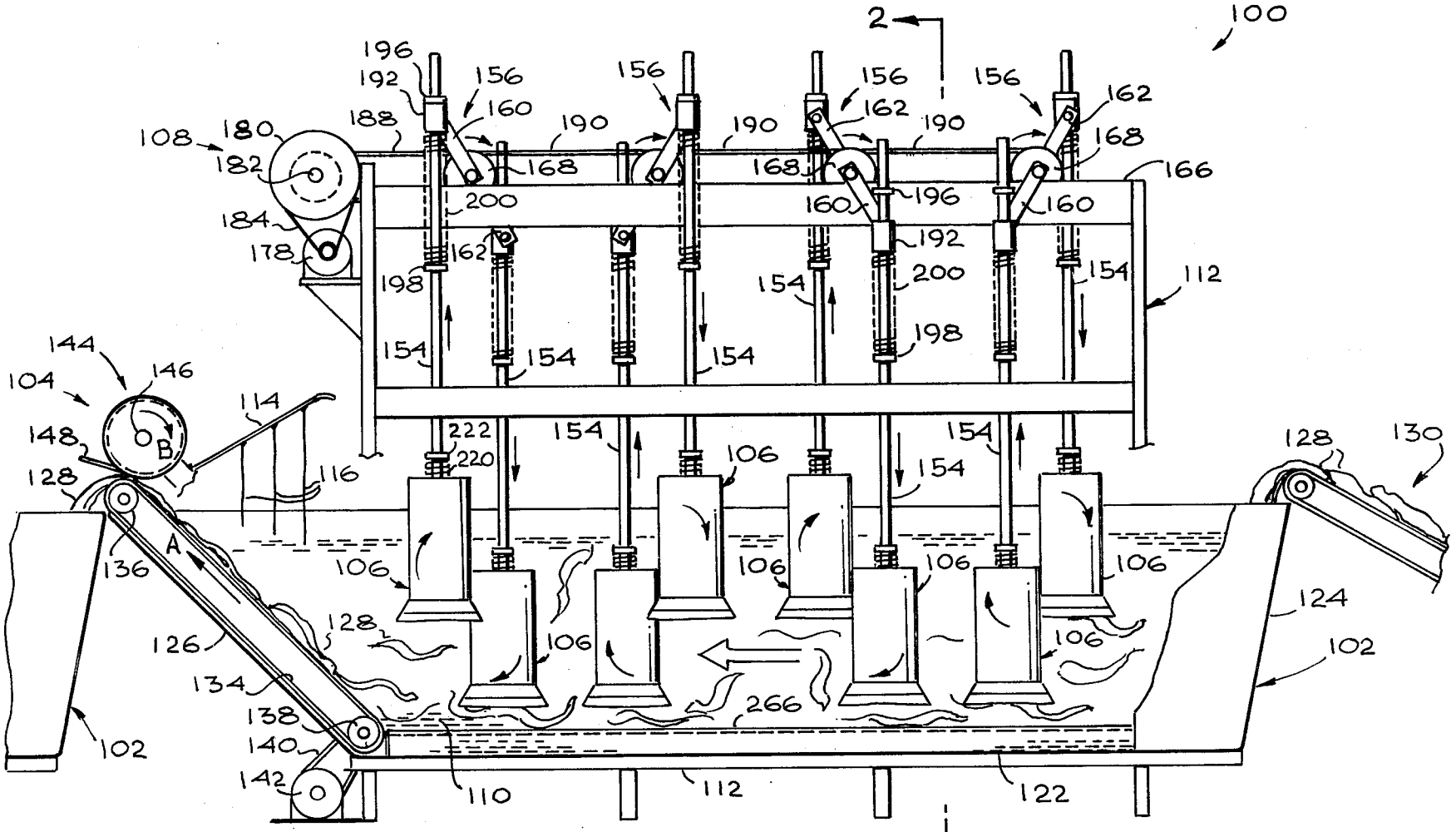
FIG. 1 is a schematic representation, partially broken away, of a laundry unit in accordance with the present invention.
Figure 2:
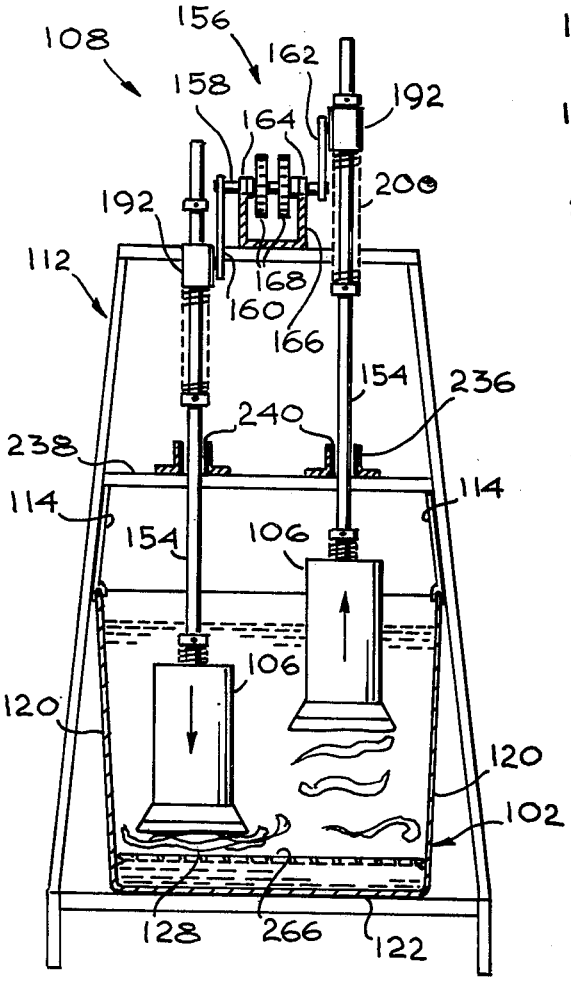
FIG. 2 is a sectional view of the apparatus of FIG. 1, taken along the line 2—2.

A single laundry unit 100 is best seen in FIGS. 1 and 2. As previously mentioned, the word laundry as used herein encompasses not only operations associated with washing but also those associated with dry cleaning, dyeing or other processing or treatment of bulk fabric items with a liquid. The laundry unit 100 comprises generally a liquid receiving tank 102 having fixed at an exit end thereof an article transferring and liquid extracting means 104, a plurality of pairs of agitators or plungers 106 (four pairs being shown), reciprocating means 108 for causing reciprocating motion of the plungers 106, and a water or liquid supply 110. The tank 102, as well as the reciprocating means 108 and the water or liquid supply 110 is supported by a frame 112. An upwardly projection shield 114, having depending baffles 116 at the downstream end, may be provided at the top of the tank 102 to prevent splashing of water or other liquid from the tank and to partially enclose the pistons 106.

As illustrated, the tank 102 is preferably constructed in the general shape of an elongate, comparatively narrow trough having inwardly tapered sides 120, a flat bottom 122, a substantially vertical entrance end 124 and an exit end 126, which is at an angle of about 45°. The tank 102 may be constructed of any corrosion resistant material such as stainless steel, fiberglass, reinforced plastic, or galvanized iron; although, for economy of construction, fiberglass of sufficient thickness to provide structural rigidity is preferred.

Figure 12:
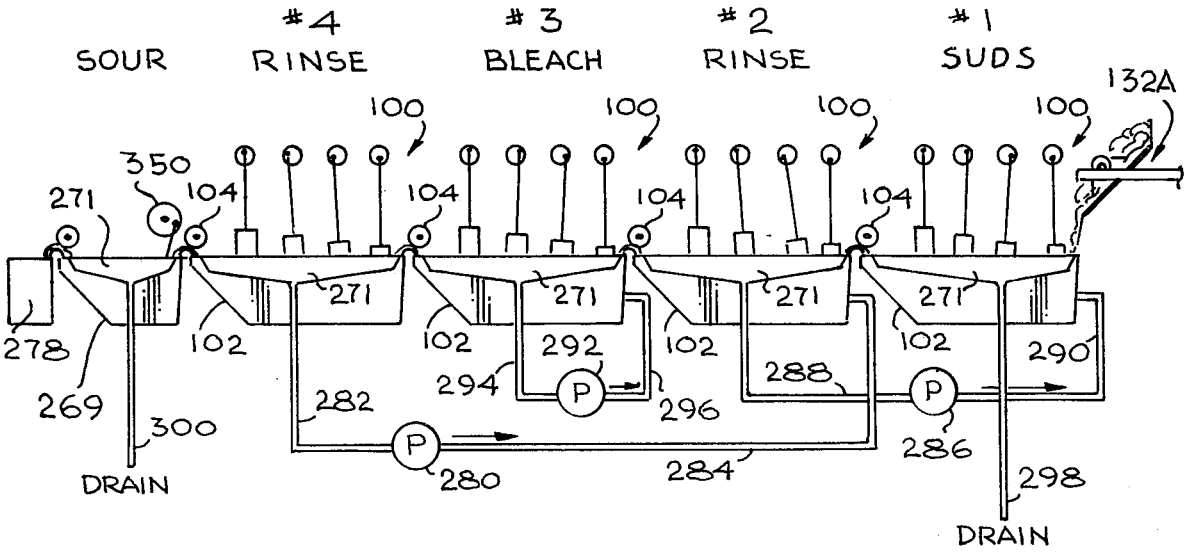
FIG. 12 is a schematic representation of a plurality of units such as that illustrated in FIG. 1 for example (or FIG. 27), combined to form a complete flow-through laundry system.

Articles 128 to be laundered are introduced into the entrance end of the tank 102 in any convenient manner. For example, an entrance conveyor 130 is shown delivering articles 128 to the entrance end of the tank. Alternatively a conventional overhead conveyor may be used (as indicated in FIG. 12).

As seen in FIG. 1, the article transferring and fluid extracting means 104 includes an endless conveyor belt 134 disposed within the tank 102 on upper and lower rollers 136 and 138, respectively, closely adjacent to the exit end 126. The lower roller 138 is driven, through a drive chain 140 and by an external motor 142, in a direction such that the portion of the belt 134 exposed to the articles 128 is moved in the direction of arrow A to transport articles coming in contact therewith up and out of the exit end of the tank.

Figure 3:
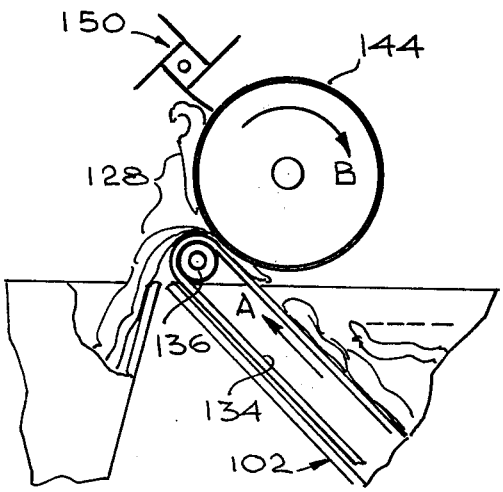
FIG. 3 is a more detailed view of a portion of the arrangement of FIG. 1, showing certain details thereof.

Mounted in driven relationship with the belt 134, adjacent the upper roller 136, is a water or liquid extracting drum or roller 144, which is caused to rotate in a clockwise direction of arrow B by contact with the moving belt. The drum 144 is mounted on a shaft 146 which is pivotably supported, in a manner not shown, by the frame 112. A comb-like member 148 is positioned between the conveyor belt 134 and the drum 144, portions thereof being disposed within circumferential drum grooves (not shown), other portions thereof extending rearwardly beyond the surface of the drum and the surface of the conveyor belt 134. By means of the member 148, articles 128 being removed from the tank 102 by the belt 134 are prevented from clinging to the surface of the drum 144. Alternatively, as seen in FIG. 3, the member 148 may be replaced by a bladed element or stripper 150 which is caused to rotate with the drum and in intermittent, scraping contact therewith. Articles 128 being discharged from the tank 102 by the belt 134 may be discharged directly into the entrance portion of a next tank 102 (shown at the left of FIG. 1) for a next laundry operation, or into any convenient receptacle.

Still referring to FIGS. 1 and 2, the reciprocating means 108 includes individual connecting rods 154, one of which is connected, at a lower end, to a corresponding one of the plungers 106. Upper ends of the rods 154 rotatably connected, as more particularly described below, to cranks 156 which are formed generally in the shape of bicycle pedal cranks. Each crank 156 thus comprises a central crank shaft 158 to opposite ends of which are fixed first and second crank arms 160 and 162, respectively. Each crank shaft 158 is positioned transversely to the tank 102 and is journalled for rotation in bearing members 164 (FIG. 2). The bearing members 164 are mounted upon a long U-channel beam 166 which is fastened to the frame 112, above the tank 102 and in a vertical plane through the longitudinal axis of the tank 102.

Fixed to each crank shaft 158 are a pair of sprockets 168, except that only one sprocket 168 is fixed to the crank shaft nearest the entrance end of the tank 102. A motor 178 is mounted on the frame 112 near the exit end of the tank 102 and drives a first sprocket 180, mounted on a shaft 182 journalled for rotation on the beam 166, by a conventional drive chain 184. A second, smaller sprocket is fixed to the shaft 182 to rotate in unison with the sprocket 180. By means of a drive chain 188 which passes over the smaller sprocket on shaft 182 and the sprocket 168 of the adjacent crank 156, the motor 178 drives such adjacent crank. Through other drive chains 190, the subsequent cranks 156 are driven through their associated sprockets 168, so that all of the cranks 156 are rotated in unison by the motor 178.

Figure 4:
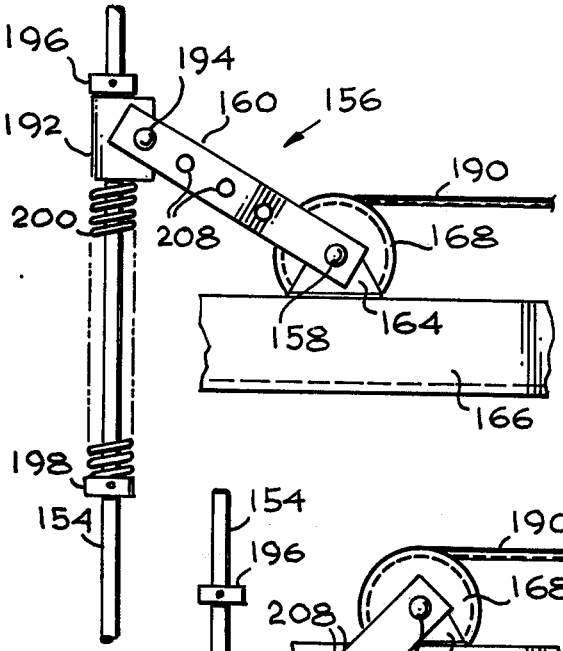
FIG. 4 is a more detailed view of a portion of the drive apparatus of FIG. 1.
Figure 5:
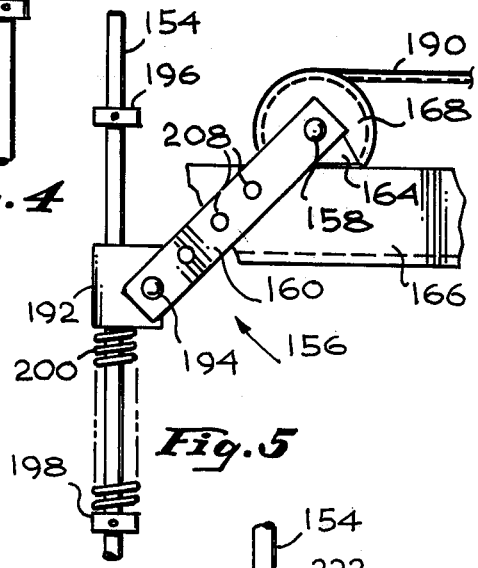
FIG. 5 is a view similar to FIG. 4 but showing the drive apparatus in a different orientation.

Pivotal attachment of upper portions of the connecting rod 154 to the crank arms 160 and 167 as seen in FIGS. 4 and 5 is by means of members 192, having a tubular portion 193 which slides over the rods, which are pivotably connected to the crank arms by pins 194. Each member 192 is confined to the associated rod 154 by upper and lower adjustable, rod-mounted locking elements or collars 196 and 198, respectively. Mounted over each rod 194, between the lower surface of the member 192 and the lower locking element 198, is a compression spring 200. By adjusting the positions of the locking collars 196 and 198, the effective length of the associated rod 154 can be varied as can the compressive force exerted by the spring 200. In addition, the length of travel of the piston rods 154 can be varied by changing the radial mounting position of the member 192 on the crank arms 160 and 162. For such purpose, a plurality of mounting apertures 208 are formed in the crank arms 160 and 162 at various radial distances from the crank shaft 158.

Figure 6:
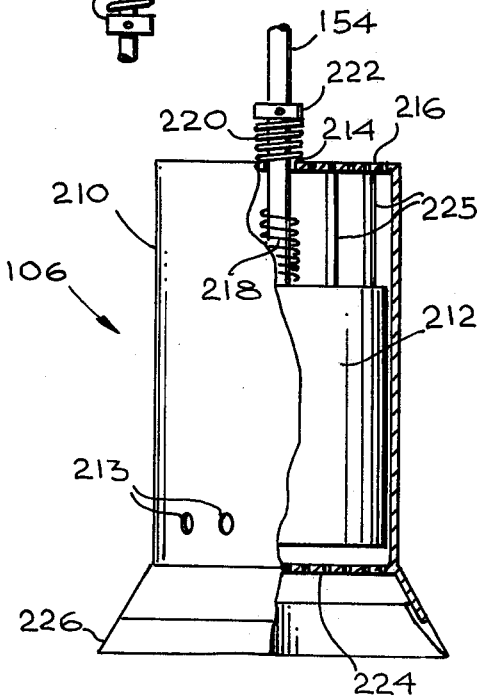
FIG. 6 is a view, partially in section, showing structural details of the plunger device of FIG. 1.
Figure 7:
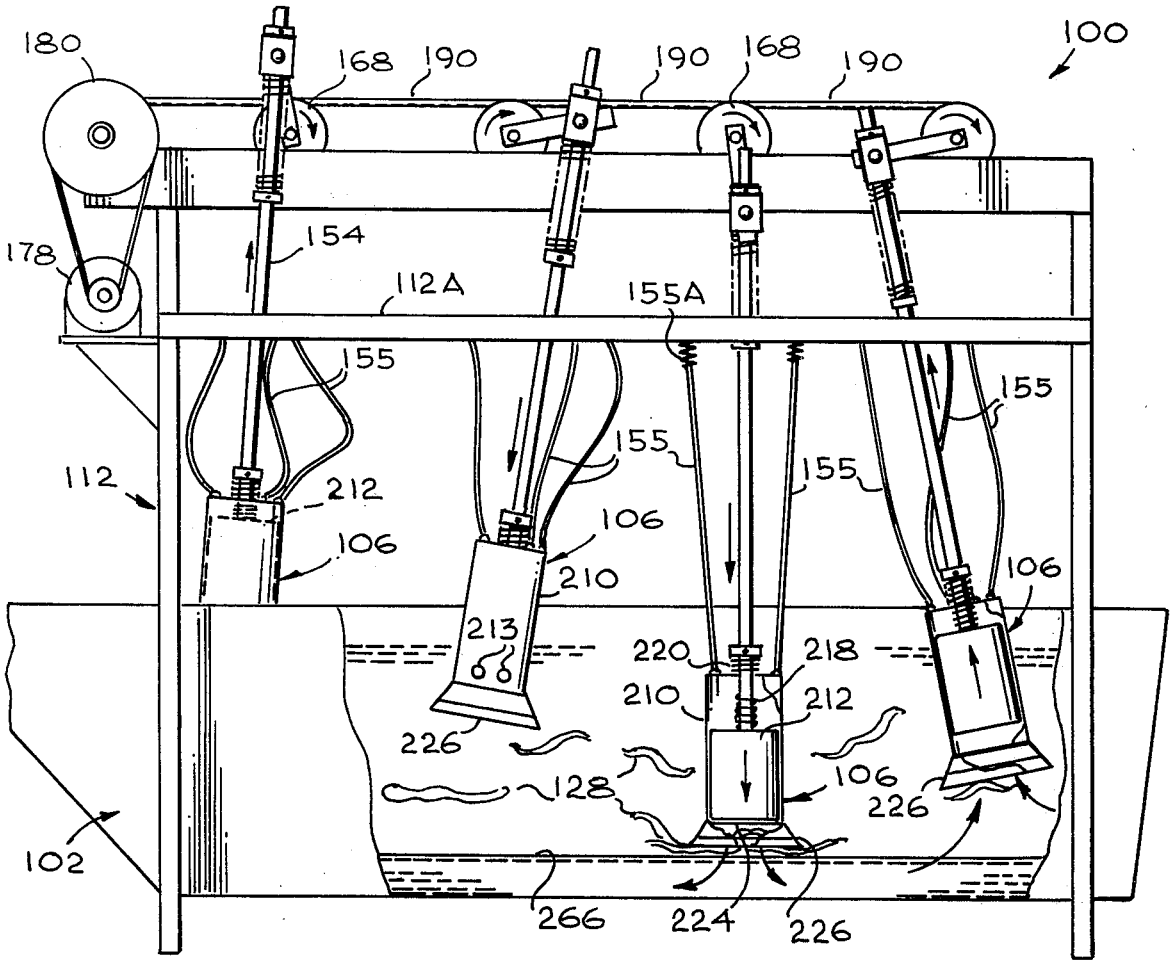
FIG. 7 is a schematic view, partially broken away, showing the details of operation of the device of FIG. 1.

Each plunger 106, as particularly illustrated in FIG. 6, comprises a tubular outer member or canister 210 having a close fitting cylindrical inner member or piston 212 disposed therewithin. As is shown in FIGS. 6 and 7, the piston 212 extends longitudinally throughout a major portion of its associated canister 210. That is to say, the length of the piston 212 is in excess of one-half the internal length of the canister 210, thus limiting the relative movement of the piston and canister so as to provide an improved bi-directional pumping action as noted hereinabove. The lower end of an associated piston rod 154 passes through an aperture 214 formed in a perforated top plate 216 fixed to the outer canister member 210 and is connected to the top of the piston 212. Preferably, a compression spring 218 is installed over the rod 154 between top of the piston 212 and the inside of the top plate 216 to bias the piston, which is shorter than the canister 210, away from the top plate 216. In addition, a second compression spring 220 may be installed between the upper side of the plate 216 and a stop collar 222 fixed on the rod 154. A perforated bottom plate 224 is installed at the bottom of the canister 210, below the bottom of the piston 212, to prevent articles 128 from entering the canister proper. Holes 213 extend about the base of the canister 210 to permit the passage of air above the perforated plate 224 as the canister clears the liquid level.

In order to provide for free sliding of the piston 212 within the canister 210, several equally spaced, longitudinal bearing strips 225 constructed, for example, from nylon or Teflon, may be installed on the inner periphery of the canister 210. The piston 212 and canister 210 are preferably constructed of a rigid corrosion-resistant material such as stainless steel or plastic.

Fastened to the flared lower portion of the canister 210 is an elastomeric skirt 226 which projects several inches below the base of the canister and the bottom plate 224 and prevents damage to articles 128 by the plungers 106, when the articles are trapped between the bottom of the plunger and the tank. Additional skirt members may be attached around the canister at points above the mounting shown to improve the operation of the washing apparatus, as directed.

The operation of arrangements in accordance with the invention is illustrated in the simplified schematic of FIG. 7. Although the arrangement depicted in FIGS. 1 and 2 shows each pair of plungers driven by the same sprocket 168 reciprocating oppositely to each other, it will be understood that they may also be arranged to reciprocate together. This is the case in the arrangement depicted in FIG. 7 and, for this reason, only one plunger 106 and connecting rod 154 combination of a given pair is visible, the other combination of the pair being movable directly behind the one which is visible. As seen in FIG. 7, the tank 102 is provided with an apertured or perforated panel or false bottom 226. The perforations in the false bottom 226 permit water to pass back and forth between sections of the tank 102 above and below the false bottom 226 but keep the laundry items 128 above the divider or false bottom 226.

As a plunger 106 enters the liquid in the tank 102 on the downward stroke, the resistance of the liquid to motion of the canister 210 shows the movement of the canister 210 relative to the piston 212. The piston 212, being positively driven, moves downward within the canister 210, driving out the water which initially entered the bottom of the canister 210 by virtue of the openings 213 and perforations in the bottom plate 224. The skirt 226 at the base of the canister 210 traps laundry items 128 against the perforated divider 226 and the liquid being driven by the piston 210 is forced downward through the laundry items 128. On the upward stroke, the piston 212 is moved upwardly within the canister 210, thus sucking liquid into the lower portion of the canister 210 below the piston 212, as illustrated for the plunger 106 on the righthand end of FIG. 7. Laundry items 128 are drawn within the portion partially enclosed by the skirt 226 and flared lower end of the canister 210 but are prevented from moving into the canister proper by the perforated base plate 224. At this point, the water is drawn upwardly by the piston 212 through the laundry items 128 trapped against the base plate 224. There is thus a two-way or bilateral flow of liquid through the laundry items, forced by the relative movement of the piston and canister, each time the plunger goes through a cycle corresponding to one revolution of the drive sprocket 168. This bilateral forced flow of liquid through the laundry items is most effective in removing soil therefrom and processing these items. At the same time, the operation of the plungers 106 is extremely gentle and easy on the laundry items 128 so that they are not mauled, mangled or torn as frequently happens with presently known equipment.

Also shown in FIG. 7 is a plurality of flexible straps 155 which are fastened at their upper ends to side-by-side frame members 112A and at their lower ends to the respective canisters 210. As shown, the straps 155 are positioned to develop forward motion of the plungers near the bottom of their travel by pulling the plungers through the water at the lower end of the stroke. These straps also serve the purpose of limiting the downward travel of the canisters 210 so as to prevent excessive force being applied against the articles 128 and the perforated divider 266 at the downward limit of the stroke of the plunger 106. As mentioned, the straps 155 are flexible so that they become slack when the plungers 106 are at positions other than at the bottom of their stroke. However, as may be seen in connection with the plunger 106 which is second from the right-hand or entrance end of the tank 102, when the plunger 106 approaches the bottom of its stroke, the straps 155 become taut and prevent the associated canister 210 from moving downward any further. The piston 212 continues to be positively driven downwardly the last few inches to the bottom of its stroke while the corresponding canister 210 is restrained against further downward travel by the associated straps 155. Three such straps 155 are shown for each of the plungers 106 in the diagram of FIG. 7; however, it will be appreciated that a lesser or greater number of such straps may be provided as appropriate. The straps should be fabricated of a material which is strong enough and supple enough to last through several hundred thousand cycles of the apparatus. A suitable ready-made material for this use has been found to be ordinary V-belting which is cut to the proper length and anchored between the frame members 112A and the canister 210 as described. Use of cut V-belts for this purpose prevents tangling when the straps are slack, since the "memory" of the V-belt material causes the individual straps to curve away from each other when slack and the belts are mounted to take advantage of this property of the material. An elastic member 155A, such as a spring or shock cord, may be included at the top of each strap 155 to absorb the shock of the strap becoming taut at the limit of travel of the cannister 210.

It may be seen from the motion of the plungers 106 as illustrated in FIG. 7 that there is a natural movement of the laundry items 128 from the right-hand end to the left-hand end of the tank 102. This follows because for clockwise motion of the drive sprockets 168, the plungers 106 are lifted from the liquid on the left-hand side of the axes of the sprockets 168 and moved to re-enter the liquid on the right-hand side of the sprocket axes. Further rotation of the sprockets 168 serves to drag the plungers 106 through the liquid from the right-hand to the left-hand side. Thus the plungers naturally move the laundry items 128 from the entrance to the exit of the tank while at the same time effectively cleaning the laundry items by the action of the pistons and canisters as described. Of course, the direction of movement is in the opposite direction where the drive sprockets 168 rotate oppositely, or counterclockwise. This can be easily accomplished, if desired, by reversing the direction of rotation of the drive motor 178.

The movement of the laundry items 128 through the tank 102 may be expedited by the provision of special means for positively driving the laundry items 128 in the direction of the exit end. One such arrangement for accomplishing an increased and more positive motion of the plungers 106 is illustrated schematically in FIG. 8. In this arrangement, the plungers 106 are connected to their respective sprockets 168 for reciprocal motion in unison. The adjacent plungers 106 are tied together by connecting straps 201 and the left-hand plunger 106 is connected to a flexible cable 202 which extends over pulleys 203 to an actuator 204, such as an air driven piston and cylinder combination mounted on a frame member 205. The right-hand plunger 106 is similarly connected to a flexible cable 202A extending over pulleys 203A and connected to a return spring 206 which is also connected to the frame member 205. In this arrangement, the actuator 204 is controlled to pull the cable 202, thus drawing the plungers 106 to the left as they are lifted by the sprockets 168 and rods 154 until the plungers 106 just clear the level of liquid within the tank 102. At this point, the actuator 204 is released and the return spring 206 draws the plungers 106 to the right-hand position where they again enter the liquid and are drawn to the left by repeated energization of the actuator 204.

Figure 8:
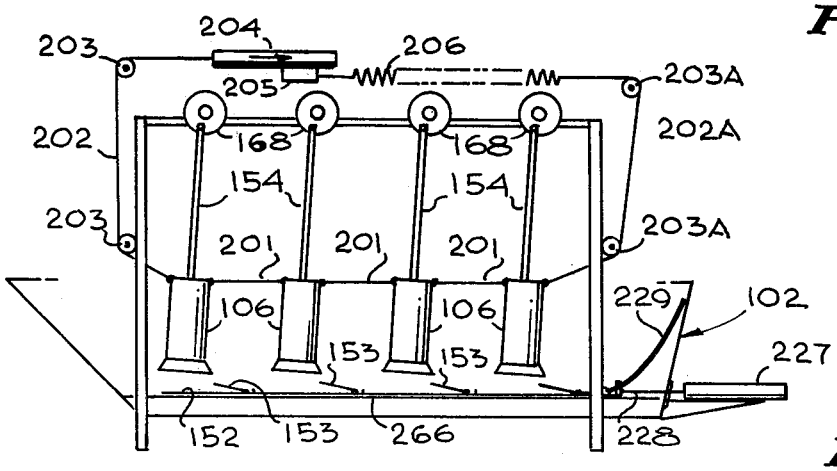
FIG. 8 is a schematic representation of arrangements of the present invention similar to that shown in FIG. 1 with details of particular apparatus added thereto.
Figure 9:
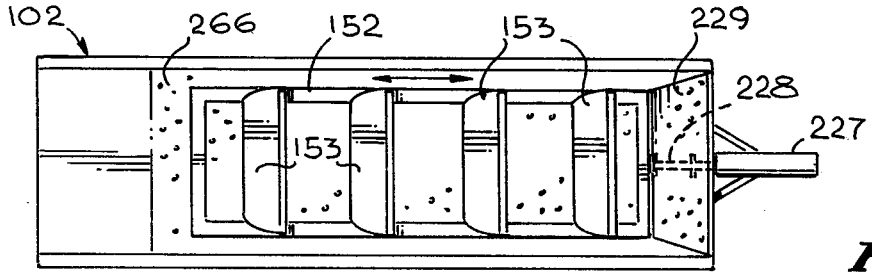
FIG. 9 is a plan view of the lower portion of the apparatus of FIG. 8.

Other means for advancing the laundry items more rapidly through the tank 102 are also shown in FIG. 8 and in the plan view of the bottom thereof, depicted in FIG. 9. These are particularly useful when it is desired to remove all of the laundry items from the tank preparatory to draining the tank for a change of liquid therein, as from a wash to a bleach cycle, for example. The additional means of FIGS. 8 and 9 comprise a slider frame 152 having a plurality of flexible blades or hinged members 153 mounted thereon. These elements 153 may be of a rubber-like material affixed to the frame 152 or they may constitute individual blade members hingedly attached to members affixed to the frame 152. The frame 152 rests on the perforated divider 266 and is adapted for longitudinal sliding motion thereon upon the activation of an associated fluid actuator 227 mounted outside the tank 102 at the inlet end. An actuator rod 228 extends through the end of the tank 102 and is attached to the adjacent end of the frame 152. Also shown for a similar purpose is a perforated or apertured flexible sheet 229, preferably of rubber or some other elastomeric material, which is attached about its sides and upper periphery to the tank 102 with its lower edge engaging the actuator rod 228. Thus as the actuator 227 drives the rod 228 back and forth, the frame 152 and the flexible sheet 229 move back and forth in unison. As the frame 152 is driven forward, away from the actuator 227, the elements 153 are raised by the action of the liquid in the tank 102, thus engaging the laundry items therein and effectively moving them toward the exit end. As the rod 228 is retracted by the actuator 227, the elements 153 tend to lie flat against the frame 152, thus moving with the frame 152 and actuator rod 228 to the retracted position without drawing the laundry items back with them. The next extended stroke of the actuator rod 228 drives the frame 152 toward the exit end of the tank, lifting the blades 153 and further acting to expedite the delivery of the laundry items to the exit end of the tank for the emptying of the tank so that the next batch of laundry items, if such there be, may be introduced at the entrance end. The flexible perforated sheet 229 and the frame 152 and elements 153 act as unilateral driving means to move the laundry items toward the exit end. As described above, the arrangement comprising the flexible cables 202, 202A and the actuator 204 and return spring 206 also act in similar fashion.

Figure 10:
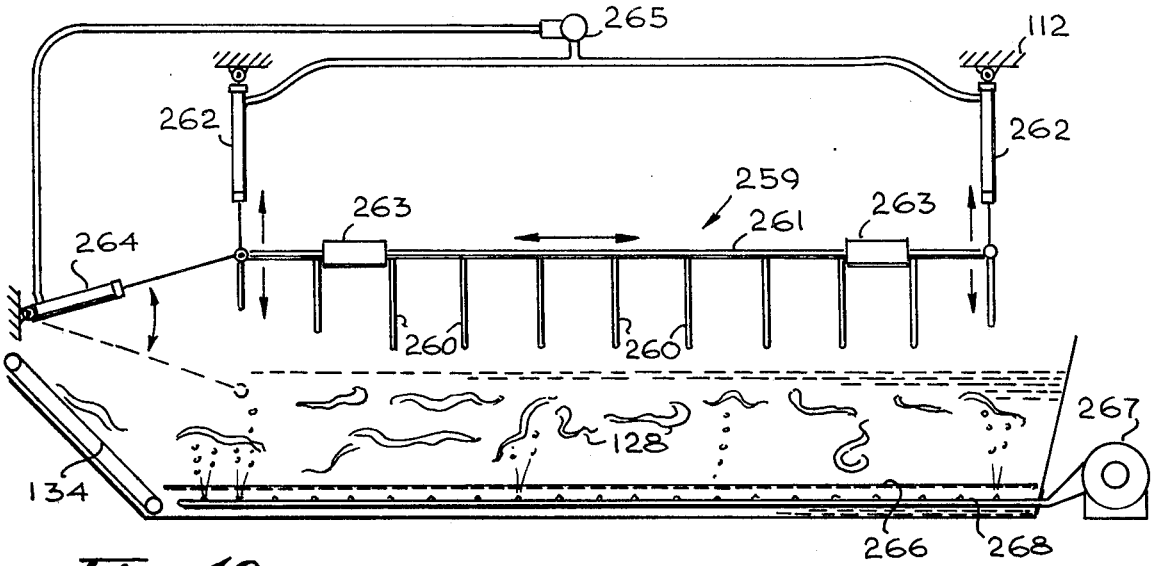
FIG. 10 is a schematic view showing an alternative arrangement for use in the embodiment of FIG. 1.

Still another alternative arrangement for expediting the movement of the laundry goods toward the exit end of the tank is shown in FIG. 10. This shows a rake 259 having a plurality of teeth 260 affixed to a support bar 261, the entire assembly being supported by cables attached to vertical actuators 262 mounted to the frame 112. The rake 259 is aligned longitudinally of the tank 102 between the two longitudinal rows of plungers (not shown, for simplicity). Guides such as the guide blocks 263 or a pair of guide rails may be positioned on opposite sides of the support bar 261 to maintain the desired longitudinal alignment of the rake 259. A third actuator 264 is pivotably mounted to the frame 112 for moving the rake 259 in a reciprocating longitudinal direction as the actuators 262 move the rake 259 up and down. Control of the actuators 262, 264 is provided by an automatically operated valve 265 so that the rake 259 is lowered into the tank 102 near the entrance end, is pulled by the actuator 264 toward the exit end where it is lifted above the liquid level by the actuators 262, returned toward the exit end by the actuator 264, and then lowered again by the actuators 262 to begin another cycle of motion. Controlled movement of the rake 259 in this manner serves to rapidly advance the laundry goods toward the outlet end of the tank 102 where they are removed by the conveyor 134.

Also shown in FIG. 10 is an air blower 267 coupled to an air tube 268 extending into and along the bottom of the tank 102 below the perforated divider 226. Along its length within the tank 102, the tube 268 is perforated to allow air to bubble upward through the liquid 110. The air introduced in this fashion serves to lift the laundry items 128 within the liquid 110, further enhancing their interaction with the plungers and with the rake 259 shown in FIG. 10 for expediting the removal of the laundry items from the tank 102. It will be understood that a plurality of the perforated tubes 268 may be distributed along the bottom of the tank 102 in order to direct the air bubbles where they will be most effective. The blower 267 may be selectively energized to inject air bubbles into the liquid 110 or not, as desired. It has been found that the injection of the air bubbles into the liquid 110 is particularly effective near the end of a run of laundry goods through the washer in order to clear the goods out of the tank 102 more effectively.

To control the movement of the connecting rods 154 and plungers 106, relative to the tank 102, during operation, various arrangements may be provided. One such arrangement, designed to prevent lateral or sideways movement of the plungers 106, is shown particularly in FIG. 2, wherein two pairs of guide rails 236 are longitudinally mounted on frame cross members 238 at about mid-height of the connecting rods 154. Bearing strips 240 may be provided on inner surfaces of the rails 236 adjacent to the rods 154 to prevent wear of the rails and rods and to provide for smooth sliding motion of the rods between the rails. (FIG. 2). The guide rails 236, however, allow movement of the rods 154 during operation in a direction parallel to the longitudinal axis of the tank, as more particularly described below.

Figure 11:
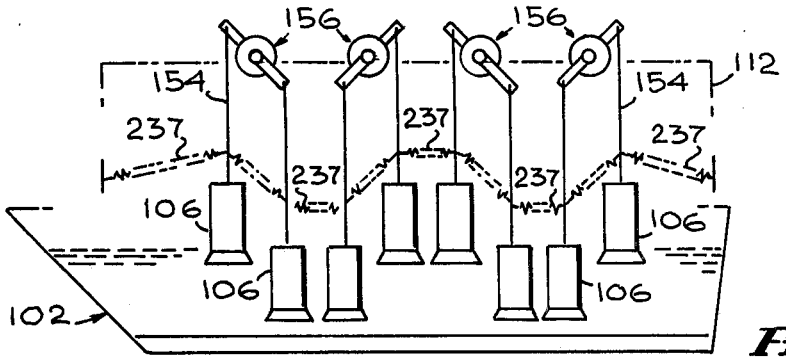
FIG. 11 is a schematic representation showing still another alternative arrangement for the embodiment of FIG. 1.

Longitudinal movement of the plungers 106 may be controlled by interconnecting the rods 154 with a plurality of springs 237, as shown in FIG. 11, upstream and downstream springs having otherwise free ends connected to the frame 112. By varying the length and resiliency of the springs 237, substantially any degree of longitudinal movement provided to the plungers 106 by the reciprocating means 108 can be developed. It is emphasized, however, that such springs 237 are not required for the operation of the unit 100, as described herein.

As illustrated in FIG. 12, a plurality of units 100 may be arranged in series or tandem relationship to form a complete laundry (or dry cleaning) operation; four of the units 100 are shown so arranged in conjunction with other equipment for completion of the processing operation. As an illustration, articles to be laundered are introduced for washing into a No. 1 unit (right-hand unit, as shown in FIG. 12) which contains soapy water (suds) with other chemicals as may be suitable. As shown in FIG. 12, the laundry goods are introduced via an overhead conveyor 132A. The articles are transported through the first unit 100 by the washing action (as described hereinabove) and are automatically transferred by the discharging means 104 into a No. 2 unit which is shown as a rinsing unit. From there, rinsed articles 128 are automatically transferred into a No. 3 unit for bleaching, and then from the third unit into a No. 4 unit which is another rinsing unit. From the fourth unit the articles are transferred into a tank 269 which contains pH balancing solution, the operation in the balancing tank 269 being commonly referred to as a "souring" operation. The completely laundered articles are automatically discharged from the last tank 269 onto or into a receiving apparatus 278 of any conventional type, for example, a conveyor belt or a hamper, from whence the laundry goods are customarily transferred to an extractor and then to a dryer for final processing.

In such a tandem arrangement of units 100, provision may be made for circulating or recirculating the liquid within a particular tank, or from one tank to another. Each of the units depicted in FIG. 12 is provided with a liquid overflow arrangement comprising a weir 271 on either or both sides of the respective tanks 102, 269. The weir is a chamber sealed to the side of the tank and communicating with the inside of the tank via holes (not shown) located at a selected height for transferring overflow liquid to the weir. A sloping bottom of the weir carries the overflow liquid to a tube or pipe for draining the weir. In the particular arrangement illustrated in FIG. 12, rinse water is pumped by a first pump 280, through lines 282 and 284, from the weir 271 of the fourth unit 100 back to the entrance end of the second unit 100; also, a second pump 286 is used to pump rinse water from the second unit 100 (first rinse unit) back into the first or wash unit 100 through lines 288 and 290. Bleaching solution is recirculated by a pump 292 and through lines 294 and 296 from the weir of the third or bleach unit 100 back to the entrance end of the same unit. Drain lines 298 and 300 are shown at the weirs of the first unit 100 and the sour unit 269, respectively, for connection directly to a waste line. Other drainlines (not shown) may be provided, together with suitable valving, to permit emptying the various tanks, when desired. Electrical controls of a conventional type (not shown) are provided for controlling operation of the motors, pumps, valves and the like. Other arrangements for interconnecting various ones of the respective tanks and for recirculating liquid in the system of the invention may be utilized—for example, see the arrangement of the schematic diagram of FIG. 24, herein. Steam connections for heating the liquid, air injection arrangements, chemical additive apparatus, monitoring and control apparatus, and storage tanks are all contemplated in conjunction with individual laundry units of the present invention, as appropriate.

A simplified laundry system embodying the present invention may be particularly useful in operations where the quantity of goods to be laundered is insufficient to justify a larger, high-rate, multi-unit system of the type just described. One such simplified system is depicted schematically in FIG. 13, which shows a single unit 100A comprising a single tank 102A with a single row of four plungers 106 and an associated conveyor belt 134 at the exit end. The tank 102A is smaller than the tanks 102 previously described in order to reduce cost, accommodate to a lesser quantity of laundry being processed and to use a lesser quantity of the various liquids required in the laundering process. It may if desired have two rows of, say, two or three plungers 106 each or it may be only wide enough for a single row of two, three or the four plungers 106 as shown. The unit 100A is provided with a weir 271 and connecting pipes 301 and 302 to drain and refill the tank 102A and to remove overflow water from the weir 271.

A plurality of tanks or reservoirs 304, 305, 306 and 307 is associated with the unit 100A for holding the various liquids (sour, rinse, bleach and suds, respectively) which are used in various stages of the laundry process in unit 100A. These reservoirs 304–307 are connected to the tank 102A via valves 308 and 309, a reversible pump 310 and respective lines 314–317.

Figure 13:
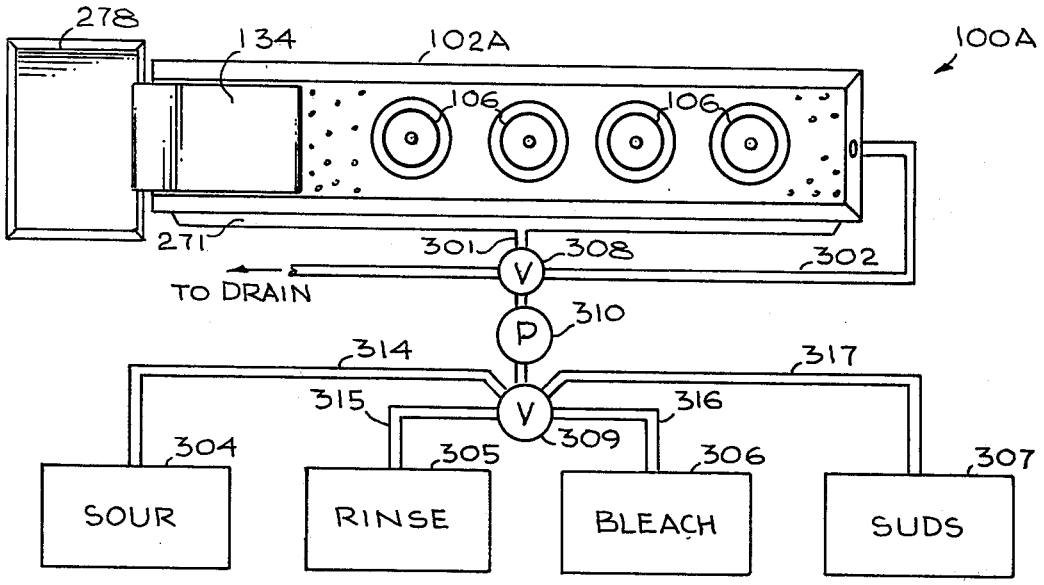
FIG. 13 is a schematic diagram plan view of apparatus such as is shown in FIG. 1 or FIG. 27 for example, particularly adapted for smaller laundry systems.

In the operation of the system of FIG. 13, the valves 308 and 309 are set and the pump 310 is operated to transfer the contents of the suds reservoir 307 to the wash tank 102A. The laundry goods are put into the tank 102A and the plungers 106 are operated in the manner previously described. At the end of this stage in the process, the goods are removed by the conveyor 134 with the suds water being squeezed out by the exit roller (not shown), and the valve 308 is set and the pump 310 operated to return the suds water from the tank 102A to the reservoir 307. Valves 308 and 309 are then switched so that the pump 310 may fill the tank 102A from the bleach reservoir 306. The washed laundry goods are then reintroduced into the tank 102A and are run through the bleach cycle, after which they are removed by the conveyor 134 and squeezed damp dry to remove the bleach liquid therefrom. Thereafter, operation of the pump 310 with the proper setting of the valves 308, 309 returns the bleach liquid from the tank 102A to the reservoir 306. Next the valves 308, 309 are set to connect the tank 102A with the rinse reservoir 305 and the pump 310 is operated to fill the tank 102A with rinse water. The laundry goods are then reintroduced into the tank 102A and, after suitable rinsing, are removed and squeezed dry, after which the rinse water is returned to the reservoir 305. Thereafter the valves 308, 309 are set to connect the tank 102A with the sour reservoir 304 and the pump 310 is operated to transfer the contents of the reservoir 304 to the tank 102A. The laundry goods are reintroduced into the tank 102A for the last time, are processed through the sour liquid to neutralize the chemicals previously used and to balance the pH of the goods as desired, after which the goods are removed from the tank 102A, squeezed and transferred for further processing, such as in subsequent extractor and dryer cycles. With the return of the sour liquid from the tank 102A via valves 308, 309 and the pump 310 to the sour reservoir 304, the laundry system of FIG. 13 is ready for another cycle of laundering with a new batch of laundry goods. Alternatively, the goods may remain in the tank 102A as the various liquids are pumped in and out in sequence until the end of the cycle, when the goods are removed as described.

As indicated, it is contemplated that a system such as that depicted in FIG. 13 will have tank 102A of relatively small capacity, for example approximately 270 gallons. The various reservoirs 304–307 are designed for a capacity of approximately 300 gallons and a 5 HP pump of the type contemplated would provide a flow rate of approximately 295 gallons per minute. Thus, only about 2 minutes would be required to drain and refill the tank 102A from one cycle of the laundry process to the next. With pumps of larger capacity, this time between cycles could be reduced.

Figure 14:
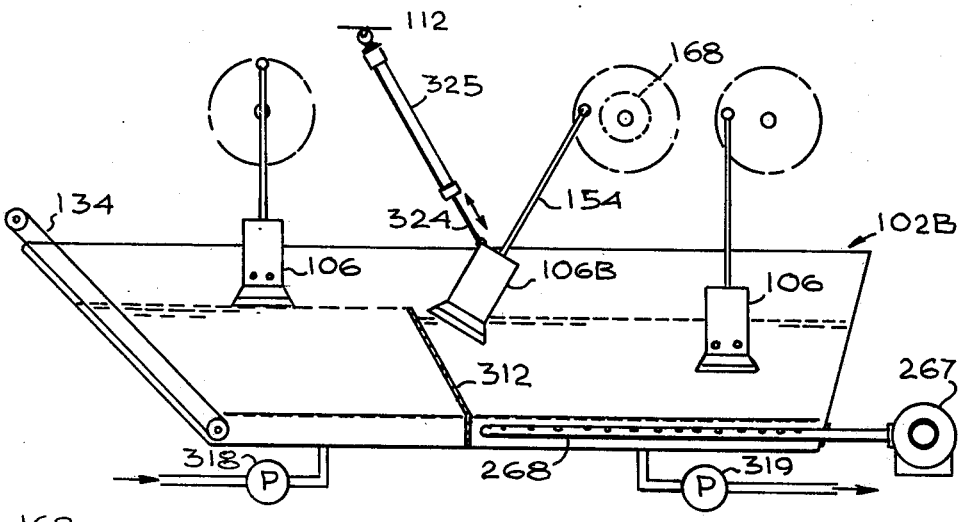
FIG. 14 shows a variation of the embodiment of FIG. 1 especially adapted for a dual purpose operation.

Another alternative arrangement in accordance with the present invention is shown in FIG. 14 as a schematic sectional drawing of a tank 102B configured for a double rinse operation. As shown in FIG. 14, the tank 102B is divided transversely by a dam or partition 312 into a first rinse section nearer the right-hand or inlet end and a second rinse section near the left-hand or outlet end. Pump 318 is provided to supply fresh water to the second rinse section of the tank 102B to a level of overflow over the top of the dam 312. Thus water from the second rinse section is being supplied to the first rinse section as fresh water is pumped into the second rinse section by pump 318. Pump 319 in the drain line of the first rinse section serves to pump water from the first rinse section at an appropriate rate, preferably for introduction to the suds tank ahead of the rinse tank. As previously described, a blower 267 and perforated air line 268 are associated with the first rinse section of the tank 102B in order to inject air into the first rinse section so that the laundry items are lifted more positively into contact with the plungers 106 therein.

Two plungers 106 are shown for operation in the first rinse section and one plunger 106 is shown operating in the second rinse section. It will be understood these may be half of corresponding pairs of plungers operating in similar fashion. The middle plunger 106B, in addition to being driven in the manner already described by associated sprocket 168 and connecting rod 154, is secured by a connection 324 to an actuator 325 which is pivotably attached to a frame member 112. This arrangement operates to draw the associate plunger 106 to the left, up and over the lip of the dam 312, as the plunger 106B is raised by its sprocket 168. In this manner, the laundry items pulled into the lower end of the plunger 106B by the suction of the internal piston moving upwardly in its canister, as previously described, are transported over the lip of the dam 312 from the first rinse section to the second rinse section where they are deposited by the plunger 106B. This simplified arrangement eliminates the need for an additional conveyor between the two rinse sections of the tank 102B. If desired, a sprocket drive such as a sprocket 168 could be used in place of the actuator 325 for the same purpose.

Figure 15:
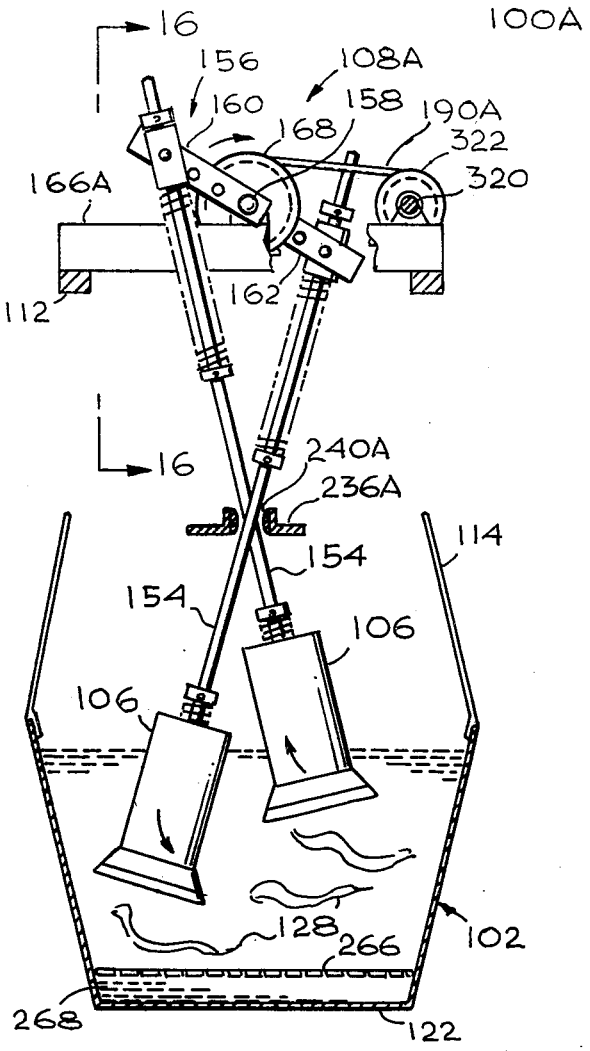
FIG. 15 shows a modification of the embodiment of FIG. 1 as it might be particularly adapted for use in the apparatus of FIG. 13.
Figure 16:
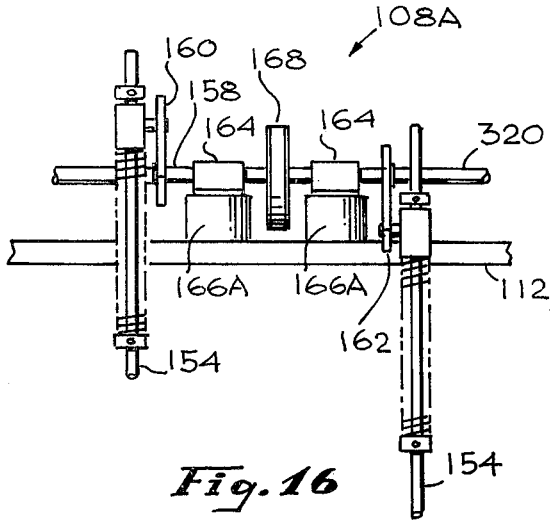
FIG. 16 is a sectional view of a portion of FIG. 15, taken along the line 16—16.

FIGS. 15 and 16 illustrate a variation unit 100A such as may be used in the system of FIG. 13, for example. This unit 100A is shown having a reciprocating means 108A in which the axes of the crankshafts 158 are rotated 90° in a horizontal plane in respect to such crankshaft axes of the above-described unit 100 (FIGS. 1 and 2), so that the crankshaft axes are at right angles to a vertical plane through the longitudinal axis of the tank 102. With such crank configuration, a common, elongate drive shaft 320, having fixed thereto separate drive sprockets 322 in the vertical planes of the crankshaft sprockets 168 (only one being used per crank 156) is journalled for rotation to the frame 112 by suitable means (not shown). The shaft 320 is connected to a reversible motor, similar to the motor 178 (also not shown), the sprockets 168, and hence the cranks 156, being driven from the sprockets 322 by separate drive chains 190A (FIG. 15). Each crankshaft 158 is mounted in bearings 164 mounted on members 166A attached to portions of the frame 112.

A single pair of piston rod guide elements 236A, having bearing strips 240A mounted on interior surfaces thereof, is provided along the length of the tank to limit lateral movement of the plungers 106 which, because of the arrangement of the cranks 156, is otherwise greater than above described for the unit 100. Otherwise, operation of the unit 100A is substantially the same as that described for the unit 100 except that there is little upstream and downstream movement of the pistons 106 as they are reciprocated. Thus, although the washing action itself remains substantially unchanged, there is little liquid pumping and hence article transporting from entrance to exit ends of the tank. This configuration is, therefore, particularly adaptable to single unit operation, wherein such article transporting may not be needed.

Figure 17:
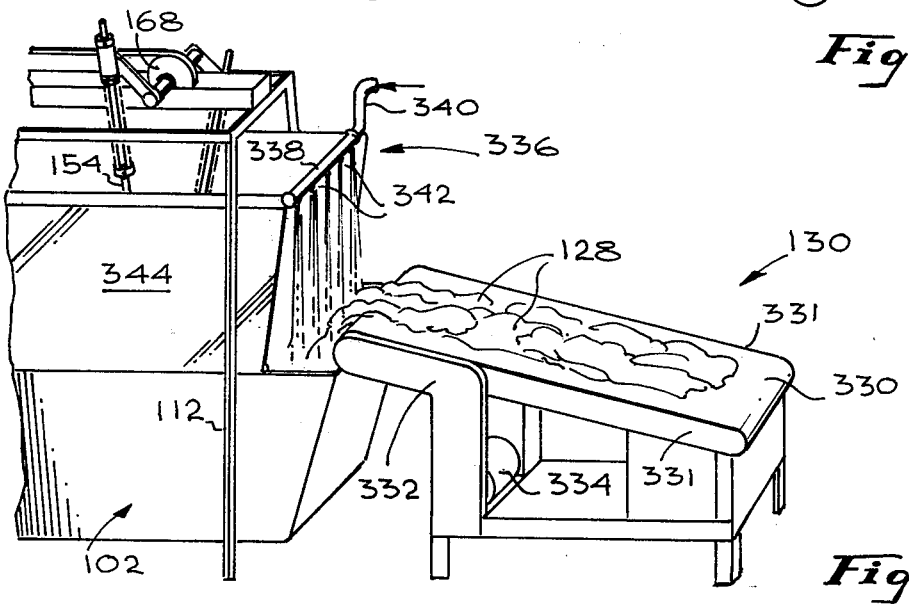
FIG. 17 is a view of the inlet end of the embodiment of FIG. 1, showing particular features thereof.

In most cases, the soiled laundry goods as introduced into the automatic laundry system of the present invention are dry, and some means should be provided to wet the laundry goods so that they do not float on top of the surface in the wash tank and thus possibly avoid being improperly processed by the plungers therein. The laundry goods at the point of their admission into the wash tank may be by means of streams of water impinging thereon. Such an arrangement is shown in FIG. 17 which shows the inlet portion of the wash tank 102 with frame members 112, connecting rods 154, and drive sprockets 168. Particular details of structure corresponding to that already described have been omitted for simplicity.

Positioned adjacent the input end of the tank 102 is the input conveyor 130 having a conveyor belt 330 with side guards 331 and a belt drive arrangement 332 driven by a variable speed motor 334. The input conveyor 130 serves to introduce the laundry items 128 in serial fashion into the tank 102 at a variable rate which may be selected by the operator. Above the entrance of the tank 102 is a water spraying apparatus 336 comprising a generally horizontal header pipe 338 fed by water either pumped from the rinse tank or drawn from the mains via a tube 340. The header pipe 338 has a number of outlet pipes 342 extending downwardly therefrom and spaced generally equidistantly along the header pipe 338. This arrangement provides a number of streams of water which form into a virtual sheet of water as they drop downwardly toward the tank 102 and serve effectively to saturate the incoming items 128 as they enter the tank 102 from the conveyor 130.

Also shown in FIG. 17 is a slidable shield or upper wall 344 above the side of the tank 102 which serves to prevent liquid from splashing over the sides of the tank but may easily be slid out of the way or otherwise removed for providing access to the interior of the tank. The splash shield 344 may be formed of a fiberglass panel or the like, for example.

Figure 18:
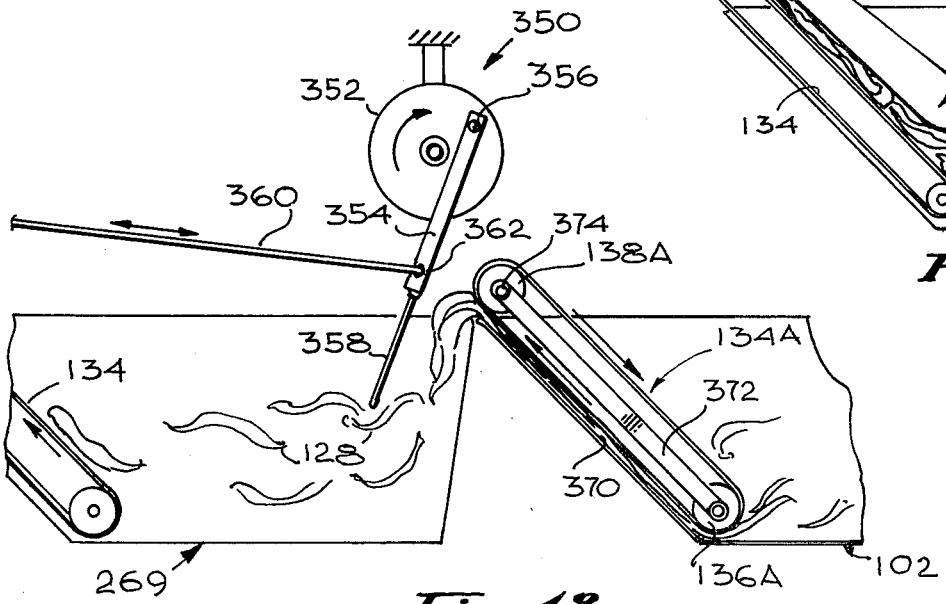
FIG. 18 is a schematic view, partially broken away, of apparatus used near the outlet end of the system of FIG. 12, showing particular features thereof.

Alternatively, the incoming laundry items 128 may be positively forced underneath the surface of the liquid in the tank 102 by means of a reciprocating rod arrangement such as is depicted in FIG. 18.

The arrangement of FIG. 18 shows the immersion apparatus 350 as it is installed at the entrance to the sour tank 269. It will be understood, however, that the apparatus 350 may also be installed at the entrance of the wash tank in place of the spray apparatus 336 of FIG. 17. Even though the laundry items 128 entering the sour tank 269 from the adjacent rinse unit (FIG. 12) are damp and not dry, the immersion apparatus 350 is needed to push the items 128 below the liquid surface in the sour tank 269 because in this particular arrangement the sour tank is operated without any of the plungers 106, the laundry items 128 being simply moved through the liquid in the sour tank 269 and to the outlet conveyor thereof.

The apparatus 350 comprises a drum or spool having opposite end plates 352 driven to rotate in the clockwise direction by a motor positioned behind the nearside plate 352. A pair of bars 354 are pivotably attached to the respective plates 352 adjacent the periphery thereof by pivot members 356. The bars 354 are joined by a cross-member (not shown) on which are mounted a plurality of push rods 358. The rods 358 are aligned side-by-side across the tank and spaced at regular intervals, providing a comb-like configuration which effectively serves to push the laundry items 128 below the surface of the liquid in the sour tank 269 so as to assure that the laundry items are completely immersed. Rotation of the spool including the end plates 352 drives the comb-like structure comprising the push rods 356 up and down, while at the same time the lower end comprising the push rods 358 is driven back and forth by an actuator rod 360 attached between the pivot pin 362 and an actuator (not shown). Thus, as the push rods 358 move downwardly to push the laundry items 128 below the surface of the liquid, they are also pulled toward the left-hand end of the sour tank 269 so that the laundry items 128 come in contact with the conveyor 134 and are drawn upwardly and out of the sour tank unit.

FIG. 18 also depicts, in connection with the rinse tank 102, a variation of the exit conveyor, here designated 134A. The conveyor 134A is shown comprising upper drive roller 138A, suitably driven by a motor (not shown), and a lower idler roller 136A mounted on a bar 372 in a manner which permits the entire conveyor assembly 134A, particularly the lower roller 136A and the bar 372 to pivot about the axle 374. The interior end of the tank 102 is provided with a low-friction surface or sheet 370, such as a molded plastic surface or a thin stainless steel sheet. In this arrangement, the goods 128 are drawn underneath the conveyor 134A and then upwardly along the low-friction surface 370 to the lip of the tank 102 from whence they drop into the sour tank 269. The pivoted arrangement of the conveyor 134A permits the conveyor to ride on top of the laundry items 128 as may be necessary to accommodate varying thicknesses of the items. However, as they approach the upper end of the conveyor 134A, particularly the drive roller 134A which is fixed in axial position, the liquid is squeezed from the items 128 prior to their delivery to the adjacent tank and retained in the rinse tank 102.

Figure 19:
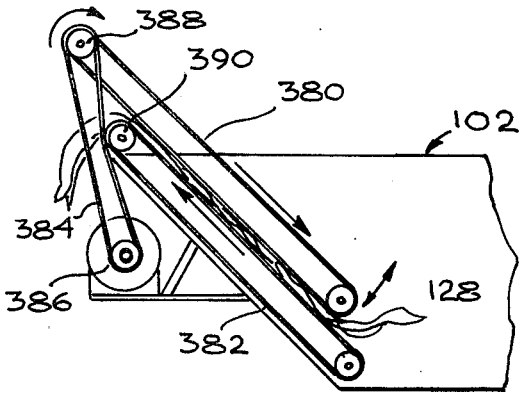
FIG. 19 is a schematic representation of an alternative arrangement of an exit conveyor such as is included in the embodiment of FIG. 1 or FIG. 27 for example.

Still another alternative for an output conveyor for removing goods from a tank 102 is shown in FIG. 19, which depicts two conveyor belts 380 and 382, mounted one above the other. Both are driven by the same drive chain 384 by drive motor 386, and at least the upper belt 380 is arranged with the lower end free to pivot about a pivot point on the axis of the upper drive sprocket 388. The drive chain 384 extends over the respective drive sprockets 388 and 390 in a manner so as to drive the belts 380, 382 in the same direction, namely upward and out of the tank 102, at their adjacent surfaces. Thus, laundry articles 128 are gripped between the two belts 380, 382 at the bottom roller end thereof and are drawn upwardly between the two belts to the exit end of the conveyor.

Figure 20:
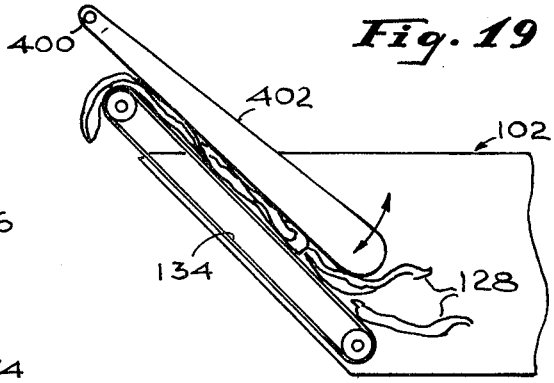
FIG. 20 is a schematic view illustrating another alternative arrangement of an exit conveyor such as may be used in the embodiment of FIG. 1 or FIG. 27 for example.

Still another alternative arrangement of the outlet conveyor is shown in FIG. 20 as comprising a single conveyor 134 above which, pivotably mounted on a pivot axis 400, is a pressure plate 402. The pressure plate 402 is suitably configured and weighted so as to assist the conveyor belt 134 in positively engaging the laundry items 128 and removing them from the tank 102, at the same time serving to apply pressure to the articles 128 so as to squeeze some of the liquid out of the articles and retain it in the tank 102.

Figure 21:
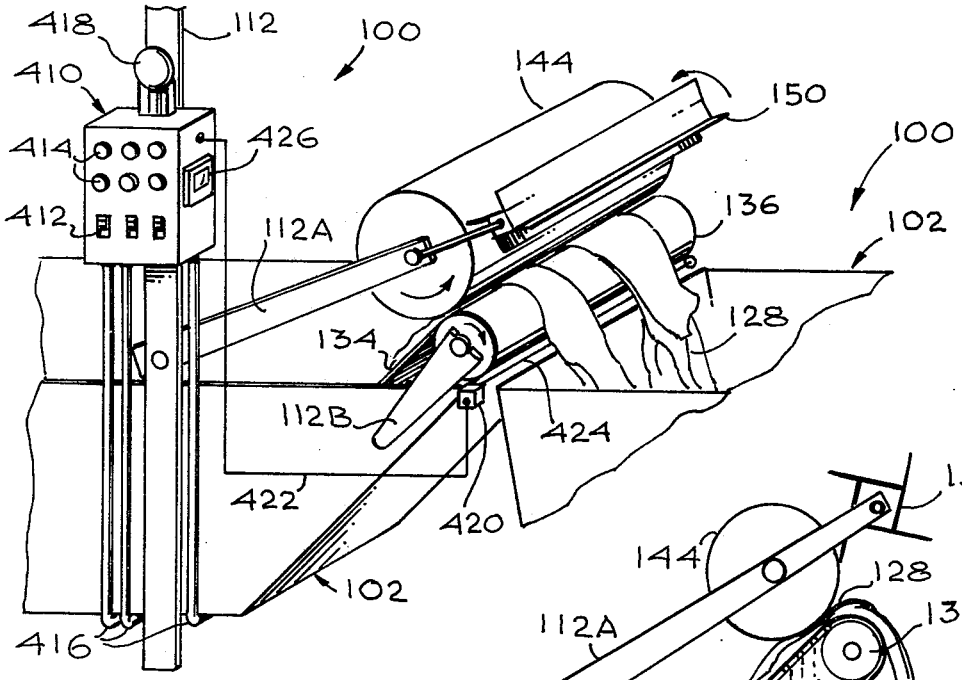
FIG. 21 is a perspective view of a portion of the arrangement of FIG. 1, showing particular details of the control system thereof.

FIG. 21 illustrates particular details of a control arrangement for apparatus in accordance with the present invention including a protection device for stopping the equipment and sounding an alarm in the event that any of the laundry articles begin to jam around the outlet conveyor instead of proceeding to the following unit as intended. In FIG. 21, a pair of adjacent units 100 are represented schematically with the outlet conveyor 134 of the left-hand tank 102 shown in conjunction with the associated drum 144 and drum wiper member 150 feeding laundry articles to the succeeding tank 102. The plungers and drive mechanisms are omitted for simplicity. As shown, the extractor drum 144 and wiper member 150 are mounted on a pivoted frame member 112A (partially broken away) which is pivotably connected to a portion of the frame 112. The roller 136 of the conveyor 134 is shown supported by an auxiliary frame member 112B.

Also shown mounted in position on a member of the frame 112 is a power panel or controller 410 which is provided to feed power to and control the electrical systems associated with the apparatus of the present invention. One such power panel 410 is provided for each of the individual units 100 of the present invention. As shown, the power panel 410 is provided with a plurality of toggle switches 412 and push buttons 414 which control the application of power via power cables 416 to the various drive motors, pump motors and other electrical devices associated with the unit 100. Also associated with the power panel 410 is an alarm bell 418. A jam alarm switch 420 is shown mounted at one side of the tank 102 just below the outlet conveyor 134. The jam alarm switch 420 is connected to the power panel 410 via a lead 422. Extending across the outlet edge of the tank 102 and connected to the jam alarm switch 420 is a cable 424 which is anchored at its far end. This cable 424 is positioned below and adjacent the roller 136 of the conveyor 134 in a position to be disturbed if any of the laundry articles 128 adhere to the conveyor 134 so as to begin to feed back under the roller 136 on the underside of the conveyor belt 134. Such movement by one of the laundry articles 128 would lead to a jamming of the conveyor unit. As soon as the errant laundry article 128 disturbs the cable 424 and before a machinery jam can develop, the movement of the cable 424 activates the jam alarm switch 420 which, when activated, performs two functions: it causes the power to the mechanism driving the roller 136 and conveyor 134 to be interrupted, thus stopping the conveyor mechanism; and it activates the jam alarm 418 so as to notify the operator that the conveyor drive has been shut off. The operator can then clear the jamming article 128 and restart the conveyor.

A temperature monitor and controller 426 is shown in FIG. 21 mounted on the side of the power panel 410 for indicating the temperature of the liquid in the associated tank 102 and for providing an automatic control of such temperature by the injection of steam or cool liquid as may be required from corresponding supply lines.

Figure 22:
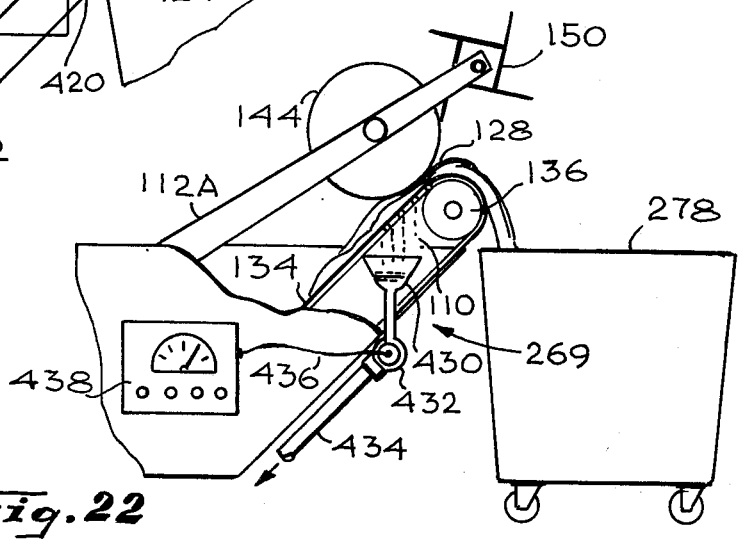
FIG. 22 is a schematic view, partially broken away, showing a particular type of controller employed in one portion of the present invention.

FIG. 22 illustrates particular details of a specialized control arrangement for the neutralizing or sour tank 269 which is at the outlet end of a continuous flow-through system of the invention (see FIG. 12). In FIG. 22 an outlet conveyor arrangement similar to that shown in FIG. 21 is also provided, incorporating the conveyor drive roller 136, the conveyor belt 134, the pressure drum 144 and the wiper member 150 at the outlet of the sour tank 269. This arrangement is shown squeezing liquid from the laundry articles 128 and feeding them into a cart 278 for further disposition or processing of the laundry articles 128. Located below the upper conveyor belt 134 and the pressure roller 144 is a collector trough 430. The belt 134 is perforated so that some of the liquid 110 squeezed from the laundry articles 128 by the pressure roller 144 bearing against the conveyor drum 136 can drop through the belt 134 into the collector trough 430. From there it drains into a sump 432 and then flows through a drain pipe 434 to the main drain (not shown). Coupled to the sump 432 is a probe 436 which is connected to a pH indicator/controller 438 which is provided to monitor the pH of the liquid 110 and to control the introduction of chemicals as may be needed to neutralize to a predetermined level the laundry articles 128. By means of the arrangement shown in FIG. 22, a better control of the pH of the actual laundry articles 128 leaving the sour tank 269 can be achieved, since it is the liquid 110 squeezed from the exiting laundry articles 128 which is sensed by the pH monitor 436 and controller 438, rather than a gross sample of the liquid in the tank 269 as would be the case if the probe 436 were mounted in the tank itself. Thus a more sensitive control of the pH, directly related to the condition of the exiting laundry articles 128, is achieved.

Figure 23:
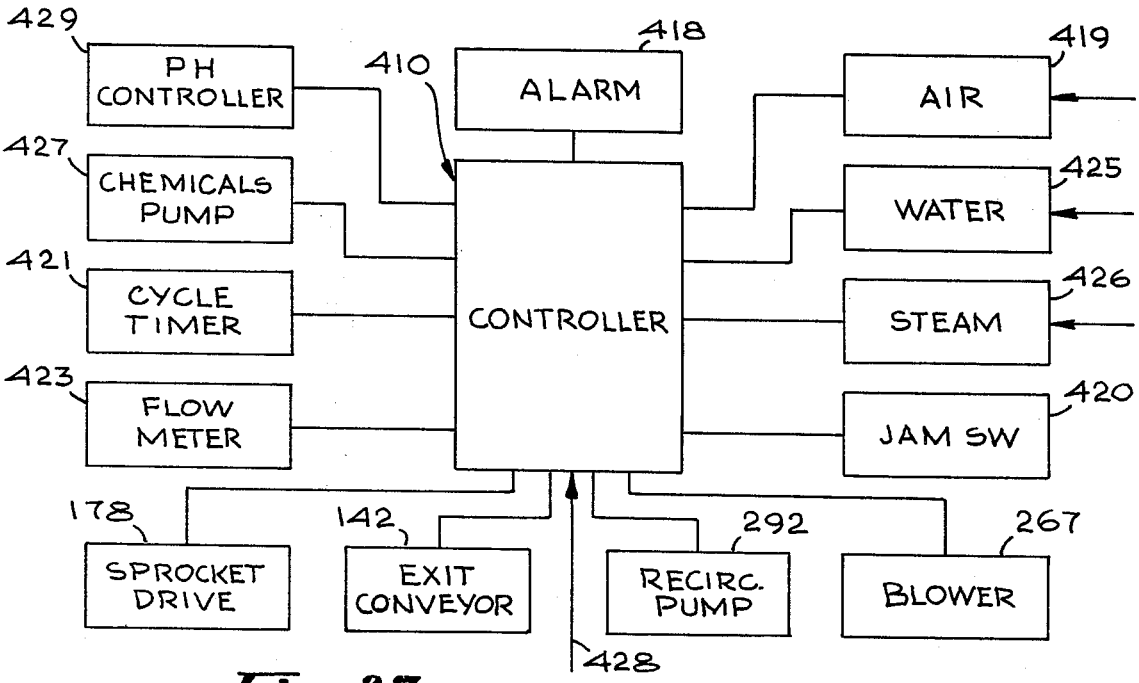
FIG. 23 is a block diagram of an electrical control system as employed in arrangements of the present invention.

FIG. 23 is a block diagram illustrating the various functions controlled by the power panel or controller 410 as shown in FIG. 21 for one of the units making up the laundry system of the present invention. As already described, the controller 410 is coupled to a jam switch 420 and a jam switch alarm 418 to shut off the exit conveyor motor 142 and activate the alarm 418 in the event of a jam at the outlet conveyor of the associated unit. Under the control of a cycle timer 421 associated with a flow meter 423, the controller 410 controls the power derived from electric mains 428 (typically 3-phase, 220 or 440 volts) to the sprocket motor 178, the recirculating pump 292, the blower 267, and the exit conveyor motor 142. The controller 410 also provides power to the chemicals pump 427 and the pH controller 429, the latter of which may activate the chemicals pump 427 in the sour unit. Air valve 419, fresh water valve 425 and steam valve 426, coupled to corresponding main lines, are also controlled by the controller 410. The various systems and components depicted in FIG. 23 operate in known fashion as described herein to provide automatically controlled operation of laundry systems according to the present invention.

Figure 24:
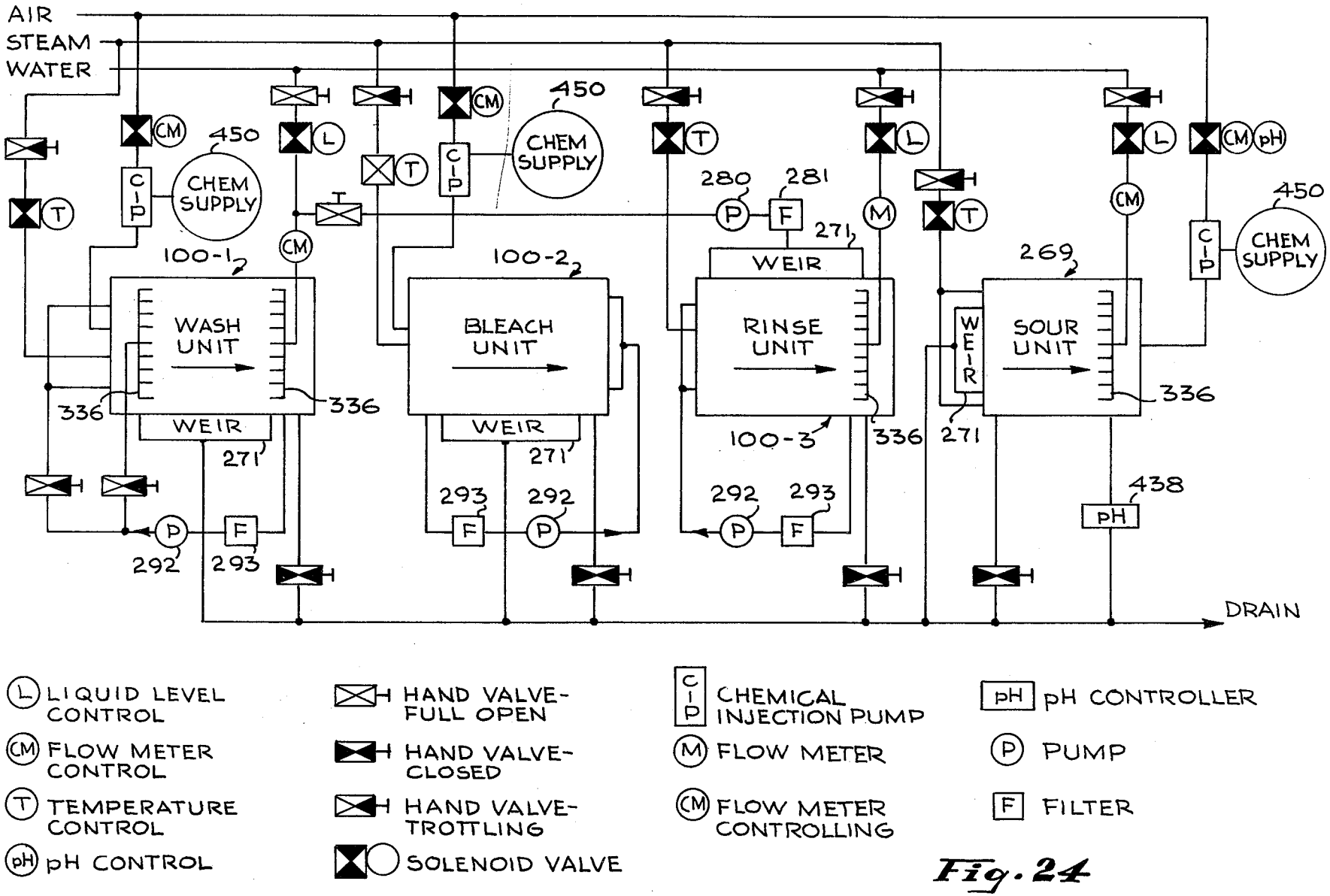
FIG. 24 is a combination block and schematic diagram with legend illustrating the interconnections and control valving for the air, steam and water supplies to one particular arrangement in accordance with the present invention.

FIG. 24 is a combination block and schematic diagram showing the various interconnections of the air, steam and water mains to the respective units of an automatic flow-through laundry system of the present invention by way of the various valves, solenoids, pumps and the like which are provided to control the operation of the system. In the diagram of FIG. 24, the flow of laundry articles is from left to right, the system beginning with the wash or suds unit 100-1, followed by the bleach unit 100-2, the rinse unit 100-3 and the sour unit 269. This system is similar to that depicted in FIG. 12 except that the first rinse unit between the wash and bleach units is dispensed with. The wash unit 100-1 is provided with a pair of spray arrangements 336 similar to that which is depicted in FIG. 17; the rinse unit 100-3 and the sour unit 269 also have corresponding spray arrangements 336. Each of the separate units shown in FIG. 24 is also provided with a weir 271 for receiving the overflow of liquid from the associated unit and directing it as indicated in FIG. 24, either directly to the main drain as with all units except the rinse unit 100-3 or in the latter case directing the over-flow liquid via a pump 280 and filter 281 for introduction into the wash unit 100-1. Recirculation within an individual unit is provided by pumps 292 and associated filters 293 for the units 100-1, 100-2 and 100-3. This recirculation can be in either direction, as desired, and for the bleach unit 100-2 is shown developing counter-flow of liquid relative to the movement of articles in the tank. Associated with each of the wash unit 100-1, bleach unit 100-2 and sour unit 269 are respective chemical supply tanks which provide various chemicals as needed to the associated laundry processing units under the control of air-driven, chemical injection pumps. Each of the various symbols shown in the diagram of FIG. 24 is identified in the legend included with FIG. 24 and therefore the diagram is considered to be self-explanatory. The respective solenoid valves are responsive to variations in different parameters as indicated, such as liquid level control, flow meter control, temperature control, and pH control. The pH controller 438 has been described in connection with FIG. 22 and includes the pH monitor probe 436 (not shown in FIG. 24). The system as represented in the combination block and schematic diagram of FIG. 24 is designed to operate with a plurality of controllers 410 of the type depicted in FIG. 23. Accordingly, from the showing and discussion presented, the operation of the system should be clear to anyone of ordinary skill in the art.

Figure 25:
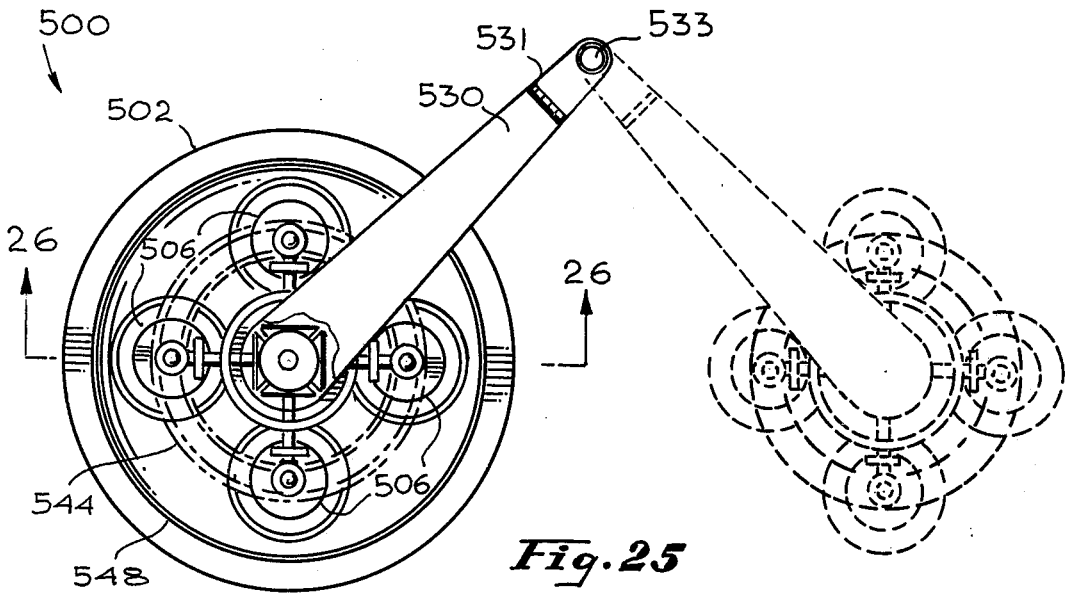
FIG. 25 is a plan view of another alternative arrangement in accordance with the present invention.
Figure 26:
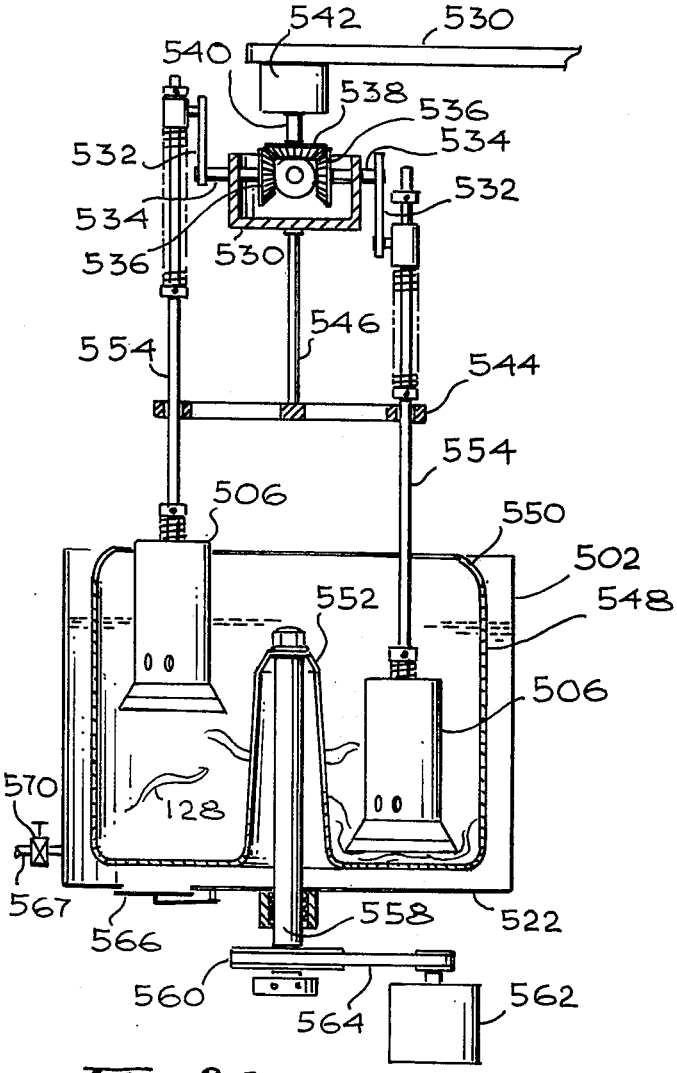
FIG. 26 is a sectional elevation of the arrangement of FIG. 25, taken along the line 26—26.

Still another alternative embodiment of the present invention is shown in FIGS. 25 and 26 in the form of a combination laundry processor/extractor unit 500 utilizing a plurality of plungers 506, similar to the plunger 106 of FIG. 6, in a gear driven arrangement. The processor/extractor unit 500 of FIGS. 25 and 26 might well be substituted for the tank unit 100A of FIG. 13 with the various liquids for washing, bleaching, rinsing and souring being introduced in sequence as described in connection with FIG. 13.

In the variation unit 500 of FIGS. 25 and 26, a generally cylindrical tank 502 employs four plungers 506 and connected rods 554 which are suspended from a hinged pivot arm structure 530 including hinge 531 and post 533, the plungers being equally spaced about a common radius from the center of the tank. The entire plunger and reciprocating means assembly may thereby be withdrawn from the tank 502 and pivoted to a position clear of the tank (as shown by dashed lines in FIG. 25) so that the tank can function as an extractor as well as a washer.

As seen in FIG. 26, crank arms 532, to which upper ends of the rods 554 are pivotably attached, are fixed to crank shafts 534, inner ends of which have fixed thereto beveled gears 536. The beveled gears 536 are driven by a single drive gear 538 connected to a drive shaft 540 which is driven by a motor 542. The shafts 534 are pivotably mounted to the arm structure 530, and the motor 542 is affixed to the structure, both in a manner similar to that described above. A circular, apertured guide plate 544 may be suspended from the arm structure 530 by one of members 546 to control sideways movement of the piston rods 554 which pass therethrough.

To provide for combination washing and spin drying action, the tank 502 is provided with a perforated or foraminous inner basket 548 having an inwardly flanged top article retaining portion 550 and having an upwardly projecting central core portion 552.

Installed upwardly through the bottom 522 of the tank 502 is a basket drive shaft 558, to the upper end of which is fixed the core portion 552 of the basket 548 so that rotation of the drive shaft causes simultaneous rotation of the basket. A lower portion of the shaft 558 projecting through the tank bottom 522 has affixed thereto a sprocket or pulley 560 by means of which the shaft is rotated by a motor 562 through a conventional chain drive or V-belt 564.

To allow discharging of water from the tank 502 during the spin dry cycle, a conventional dump valve 566 is provided at the bottom of the tank. A fill line 567, having a fill valve 570, is provided in the side of the tank 502 near the bottom for filling the tank with liquid, as by connection via the pump 310 to the respective storage reservoirs in the system of FIG. 13 when the unit 500 is installed in such a system in place of the unit 100A.

The washing operation is substantially as above-described for the unit 100 (FIGS. 1 and 7), the crank arms 532 being rotated by the motor 542 to cause a reciprocating action of the plungers 506 in an alternating, sequential manner. During this washing operation, the perforated basket 548 is maintained in a non-rotating condition, the liquid and articles being caused to circulate around the tank 502 by the above-described pumping action of the plungers 506. When the washing cycle is completed, the arm structure 530 with associated plungers 506 is swung up out of the tank 502, pivoting first about the horizontal hinge 531 in arm 530 and then rotating about the vertical support post 533, to the alternate exterior position shown by the broken line outline in FIG. 25. The dump valve 566 is then opened to drain water from the tank; when the tank is drained the motor 562 is actuated to spin the basket 548 to extract water from the articles 128 by centrifugal action. It is to be understood that such operation may be made completely automatic by use of conventional electrical circuitry and electrically controlled actuators for moving the arm structure 530 such as the control system of FIGS. 23 and 24.

If desired, the articles 128, for ease in removal, may be contained in a mesh bag which hooks over the top 550 of the basket 548, so that after the spinning operation is completed the articles may be easily removed from the basket.

Figure 27:
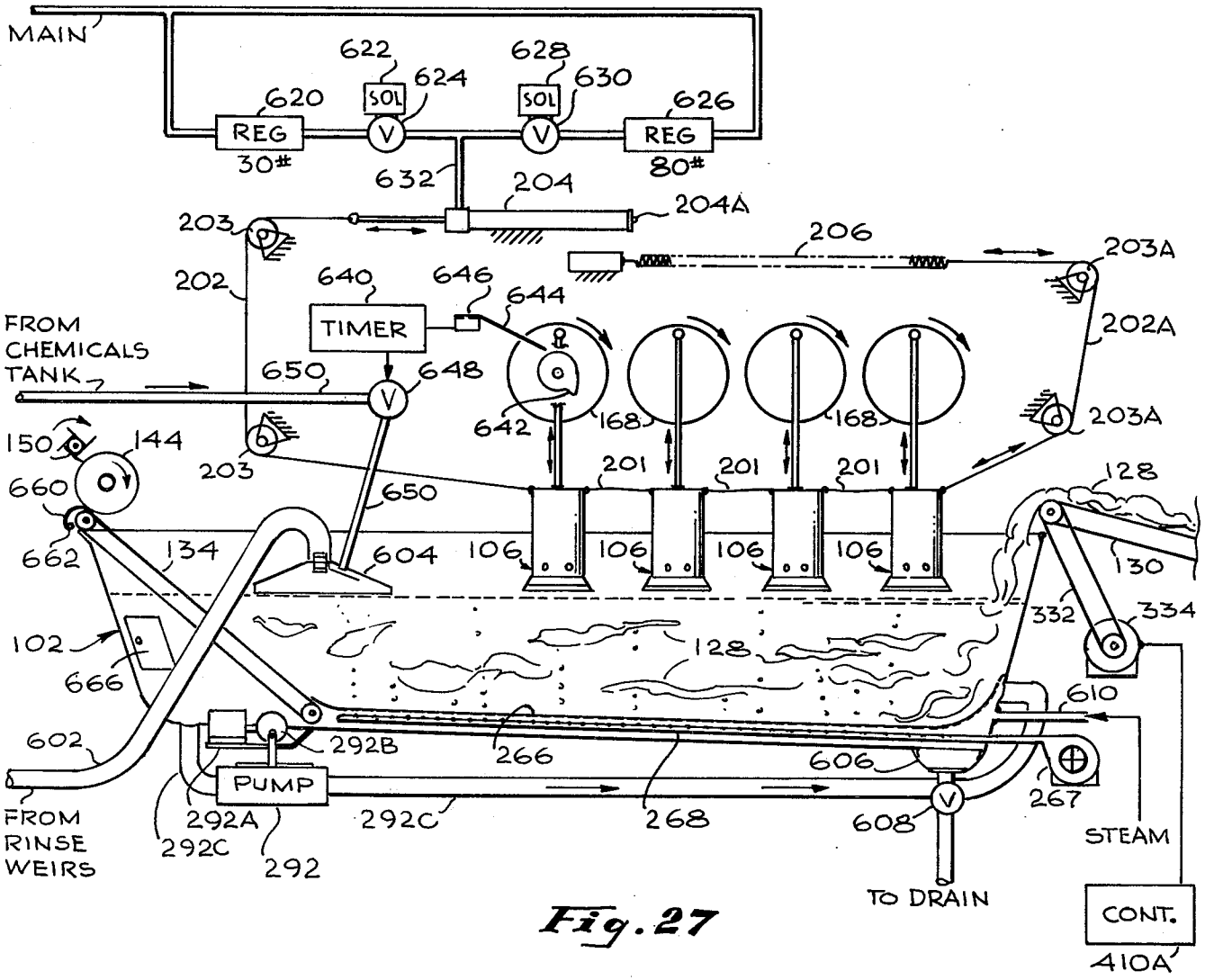
FIG. 27 is a schematic elevational view illustrating a preferred embodiment of the invention.

FIG. 27 depicts in schematic diagram form the suds unit such as the unit 100-1 of FIG. 24 of the preferred embodiment of the invention. FIG. 27 shows a tank 102, preferably fashioned of fiberglass or some similar material, having a series of plungers 106 associated therewith for reciprocating vertical motion as driven by the sprockets 168 and corresponding drive mechanisms as already described. In this preferred embodiment two sets of plungers 106 are employed, four plungers in each set displaced longitudinally in a row. Those plungers 106 of a set are driven up and down together in synchronous fashion.

The tank 102 is shown equipped with a perforated bottom 266 and an air injecting system comprising a blower 267 and perforated air lines 268. A recirculating pump 292 with drive motor 292A, rotating cam member 292B and suitable lines 292C are provided for circulating the liquid from the outlet end to the inlet end of the tank 102. The pump 292 is preferably a type of pump which needs no filters to protect it from towels, washcloths and the like, since it has a capability of pumping such articles right through and will handle any laundry article that can get through the waterlines 292C. A similar line 602 is shown transporting water from the weirs of the associated rinse tank to a splash plate 604 to distribute the rinse water thus received across the outlet into the suds tank 102. In this embodiment, the overflow rinse water from the weirs of the rinse tank is pumped into the suds tank 102. It will be noted that the suds tank 102 has a slight slope to the bottom thereof so that the heavier dirt and other soil particles will naturally gravitate toward the inlet end of the tank 102 where the drain 606 and drain valve 608 are located. A steam line 610 is provided for heating the water in the suds tank 102 under the control of the temperature monitor (not shown in FIG. 27).

Figure 28:
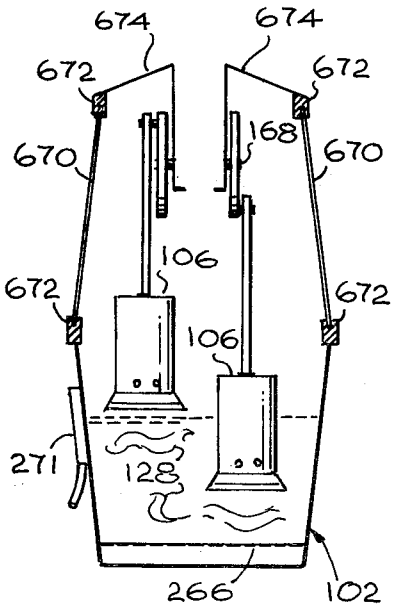
FIG. 28 is a schematic cross-section of the embodiment of FIG. 27.

FIG. 28 is a schematic cross-sectional view of the preferred embodiment which is represented in FIG. 27. It will be noted that the plungers 106 on opposite sides of the tank 102 are driven out of phase with each other. That is, when the plungers 106 moving in unison along one side of the tank 102 are moving in a downward direction, those plungers 106 on the opposite side of the tank 102, being 180° out of phase with the plungers 106 on the first side, are moving upwardly but in unison with each other. As previously shown in connection with FIG. 8, a longitudinal drive system comprising the actuator 204 and drive cables 202 and 202A is associated with the plungers 106 in a longitudinal row. Those plungers 106 along one side of the tank are tied together by flexible straps 201. It will be understood that two such longitudinal drive systems are provided, one for each of the sets of plungers on opposite sides of the tank 102. The actuator 204 is provided with an end opening 204A and suitable connections to the main air supply are controlled by a first pressure regulator 620, solenoid 622 and transfer valve 624 and a second regulator 626, solenoid 628 and transfer valve 630. Both of valves 624 and 630 feed air under suitable pressure as regulated by the associated regulators 620, 626 to a common pressure manifold 632 connected to drive the actuator 204. The first regulator 620 supplies low pressure air (approximately 30 psi.) to the valve 624. The second regulator 626 provides high pressure air (approximately 80 psi.) to the second valve 630. Control of the solenoids is provided by suitable connections (not shown) to the controls of FIG. 23.

In normal washing operation, it is desired that the plungers 106 simply move up and down to scrub the laundry items 128 in the manner already described. The recirculation of water from the outlet end to the inlet end through the pump 292 serves to move the laundry items 128 through the tank at a proper rate to achieve effective cleaning during their traversal of the tank 102 from the inlet end to the outlet end where they are then removed by the conveyor 134. During such operation, it is desired to maintain the flexible cables 202 and 202A taut without driving the plungers 106 longitudinally. This is accomplished by energizing the first solenoid 622 to open the first valve 624 and apply low pressure air to the actuator 204. This is not of sufficient pressure to drive the actuator 204 but simply causes the actuator 204 to take the slack out of the cable system while the plungers 106 move up and down. On occasion, however, as for example when the laundry system is being changed from lightly soiled items to heavily soiled articles or vice versa, it may be desired to empty the tank 102 rapidly in order to effectuate the interruption of the automatic flow-through laundry process. At such time, solenoid 622 is deenergized so as to close the valve 624. The second solenoid 628 is then selectively energized under the influence of the associated controller (see FIG. 23) to open and close the second valve 630, thus intermittently activating the actuator 204 in synchronism with the motion of the plungers 106. In such operation, the actuator 204 pulls the line 202 as the plungers 106 reach the bottom of their travel. This pulls the entire set of plungers 106 toward the outlet end of the tank 102. As the plungers rise on the next stroke, the solenoid 628 is deenergized, closing the transfer valve 630 to block high pressure air from the regulator 626 and connecting the line 632 to atmosphere, thus releasing the drive rod of the actuator 204. With the plungers 106 now at the top of the stroke, the spring 206 acts to pull them toward the inlet end of the tank 102. Such a cycle is repeated until all of the laundry items 128 are moved to the outlet end of the tank 102 and removed therefrom by the conveyor 134. Such action is very effective in emptying the tank and typically takes no more than two or three minutes. The next laundry items of a different type may now be introduced into the suds tank 102 by the conveyor 130. By suitably controlling the solenoid valve system associated with the actuator 204, the degree of advancement of the articles 128 effected by driving the plungers 106 longitudinally may be varied in accordance with the average time which is desired for the traversal of the tank 102 from inlet end to outlet end by the laundry articles 128. Consistent therewith, the input conveyor 130 will be run at a controlled rate by having the controller 410*a* drive the variable speed motor 334 at a selected speed. Thus for example more heavily soiled laundry articles 128, such as work uniforms or coveralls, may be caused to take a longer time to traverse the tank 102 from inlet to outlet than in the case of lightly soiled articles 128, such as sheets and pillow cases.

A timer 640 is shown in the system of FIG. 27 associated with one of the drive sprockets 168. This drive sprocket 168 is provided with a cam 642 which rotates with the sprocket 168. A cam follower 644 serves to close the switch 646 with each revolution of the cam 642. The closing of the switch 646 is detected in the timer 640 which serves to control a valve 648 connected in the supply line 650 from the chemicals tank. The outlet of the chemicals supply line 650 terminates adjacent the splash plate 604 and any chemicals introduced to the tank 102 are dispersed along with the water coming in through the line 602. The control system just described serves to introduce additional chemicals for the suds operation corresponding to the rate at which the washer is operated; that is, in proportion to the rate of strokes of the plungers 106. The plungers 106, as previously described, may be driven at a rate selected by the operator. Typically, the faster the plungers 106 are driven, the more rapidly the laundry items pass through the suds tank 102 and additional chemicals are to be introduced proportionately. As already described, the pH of the water in the tank 102 may be monitored and a control provided in accordance with that parameter to control the introduction of chemicals from the chemicals tank, as an alternative to the control represented by the timer 640 in FIG. 27. Another alternative arrangement for controlling the introduction of chemicals to the tank 102 is to make the valve 648 responsive to the monitoring of the parts per million of such chemicals in the suds water of the tank 102.

Associated with the conveyor 134 and shown at the uppermost, outlet end thereof are a plurality of curved wires or rods 660 secured to a cross bar 662. These wires or rods 660 extend downwardly along the upper surface of the conveyor 134 and are positioned in longitudinal grooves formed in the face of the conveyor belt 134. These rods 660 serve to prevent any of the laundry articles from feeding back around the underside of the conveyor belt 134, thus absolutely preventing any jams of laundry items at this point.

A hinged door 666, suitably sealed to the tank 102 when closed, is provided to permit manual access to the interior of the tank 102 underneath the conveyor 134 just in case any laundry articles somehow get into that region.

FIG. 28 particularly illustrates the manner in which the preferred embodiment of the present invention is completely enclosed so as to prevent the splashing of water out of a given unit. Side panels 670 are shown mounted in frame member 672 and top panels 674 extend between the upper frame member 672 and that portion of the frame which is provided to support the sprockets 168. These panels, preferably the side panels 670, can be made to slide longitudinally relative to each other (note the guide recesses in the frame members 672) to provide access into a given laundry unit from the side at any point along its length.

With the provision of the longitudinal drive system for the plungers 106 in the operation of the plungers in the manner described, it becomes unnecessary to have any auxiliary pushers or other means for rapidly advancing the laundry items 128 to the outlet end of the tank. Thus the arrangements of FIGS. 9 and 10 may be dispensed with when the preferred embodiment of the invention depicted in FIGS. 27 and 28 is employed.

As thus shown and described, arrangements in accordance with the present invention present a vast improvement over priorly known systems in the area of commercial, automatic or semi-automatic, flow-through or batch laundry or similar processing operations. Instead of the large drum-type machinery units constructed principally of high grade, costly stainless steel such as are presently on the market, the tanks and many other components of the present system may be fabricated of fiberglass or plastic at substantially lower cost with less stringent requirements for maintenance and upkeep. Instead of having to be fabricated in large centralized manufacturing plants, the arrangements in accordance with the present invention may be constructed almost anywhere from materials readily at hand. Instead of elaborate computerized set-ups such as are offered in conjunction with certain large automatic laundry systems presently on the market, the automatic flow-through systems in accordance with the present invention may be controlled by standard cycle timers, solenoid valves, and conventional sensing and monitoring elements, in large measure by virtue of the fact that the operation of the system inherently develops an automatic processing of the laundry or other articles involved. For example, it has been found that the higher the rate at which laundry articles are introduced at the inlet end of one of the units 100 (FIG. 1), the higher the rate at which the articles automatically progress from inlet to outlet through the unit. To compensate for such variation, the drive mechanism associated with the plungers may be varied in speed so that the washing or other processing action is accelerated with respect to each individual plunger and each individual laundry article. Furthermore, it has been found that systems in accordance with the present invention are much more saving of the processing liquid and associated chemicals than are conventional systems presently in use. For example, one particular system corresponding to that illustrated schematically in FIG. 24 uses about one gallon of water for each pound of laundry processed through the entire system. This is about one-third the water consumption of conventional laundry units of comparable size and capacity (typically 1800 to 2000 pounds of laundry per hour).

Although there have been described above specific arrangements of an automatic cleaning apparatus in accordance with the present invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Automated laundry apparatus, which comprises:

at least one tank adapted for containing a liquid and articles to be laundered;

a plurality of plungers movable relative to the tank for processing articles within the tank, said plungers comprising a piston, a cylinder encasing said piston and axially movable relative thereto, and means for engaging the cylinders by the pistons to cause movement of the cylinders by movement of the pistons;

means for selectively driving the plungers to process said laundry articles including a plurality of piston rods, each coupled to an associated piston, for driving the plungers in generally vertical reciprocating motion relative to the tank and means for driving the plungers in a selected phase relationship relative to each other;

the driving means further including a rotatable crank having rotatably connected to each opposite end portion thereof an upper end portion of one of the piston rods, the end portions of the crank being laterally offset on a crankshaft, and a driving member affixed to a central portion of the crankshaft; the crank having sleeves slidably mounted over upper end portions of the piston rods, the sleeves being rotatably mounted to the end portions of the crank and further including selectively movable upper and lower slidable stops affixed to each piston rod for limiting the extent of sliding of the piston rods through the sleeves, an upper stop being mounted above a corresponding sleeve and a lower stop being mounted below the corresponding sleeve, and a compression spring installed around each connecting rod between a lower portion of the sleeve and the lower stop, the spring thereby biasing the associated piston rod downwardly;

means for rotatably driving the driving member to thereby cause rotation of the crank and reciprocating motion of the piston rods connected thereto; and control means for controlling the driving means.

2. Apparatus of claim 1 wherein end portions of the cranks include a plurality of radially spaced piston rod mounting apertures, permitting the effective crank arm length to be selectively varied according to the desired amount of reciprocating movement of the piston rods and pistons.

3. Apparatus of claim 1, including a plurality of tanks arranged in series relationship, each of the tanks having an entrance end and an exit end and the tanks being arranged so that an exit end of an upstream tank is closely adjacent to an entrance end of an adjacent downstream tank, each tank having a separately operable set of plungers and driving means associated therewith.

4. Apparatus of claim 3 further including liquid extraction and article transfer means installed at exit ends of each of the tanks to provide for automatic transfer of laundry articles from each tank in the series to a next adjacent downstream tank in the series, and for extracting liquid from the articles before they are transferred.

5. Apparatus of claim 4 including first recirculating means for recirculating liquid from at least one downstream tank to a tank upstream thereof.

6. Apparatus of claim 5 including second recirculating means for recirculating liquid from the exit end of at least one tank to the entrance end of the same tank.

7. Apparatus of claim 3 further including a tank having means for wetting articles introduced into the tank.

8. Apparatus of claim 7 wherein the wetting means includes means for immersing the articles in liquid within the tank, said means including a rotatable member mounted relative to the tank and a plurality of push rods eccentrically coupled to the rotatable member for generally vertical reciprocating motion as the rotatable member is rotated.

9. Apparatus of claim 8 wherein the rotatable member comprises a drum having opposite end plates and eccentrically mounted pivot means attached thereto for coupling to the push rods.

10. Apparatus of claim 9 wherein the plurality of push rods are aligned side-by-side across the tank and spaced at regular intervals in a comb-like configuration.

11. Apparatus of claim 8 wherein the immersing means further comprises means for driving the articles through the tank from the entrance end toward the exit end.

12. Apparatus of claim 11 including means connected to the push rods at a point spaced from the rotatable member coupling for driving the lower ends of the push rods through the liquid in the direction of the exit end during the traversal of the push rods through the lower portion of their generally vertical reciprocating motion.

13. Automated laundry apparatus, which comprises:

at least one tank adapted for containing a liquid and articles to be laundered;

a plurality of plungers movable relative to the tank for processing articles within the tank, said plungers comprising a piston, a cylinder encasing said piston and axially movable relative thereto, and means for engaging the cylinders by the pistons to cause movement of the cylinders by movement of the pistons;

means for selectively driving the plungers to process said laundry articles including a plurality of piston rods, each coupled to an associated piston, for driving the plungers in generally vertical reciprocating motion relative to the tank;

auxiliary means for controlling the movement of the plungers separately from the reciprocating motion developed by the driving means, including means for limiting the downward movement of the cylinders at a predetermined point spaced above the bottom of the tank;

the limiting means comprising flexible restraining members having opposed ends anchored respectively to the frame of the apparatus and to corresponding cylinders; and control means for controlling the driving means.

14. Apparatus of claim 13 wherein the restraining members are anchored to the cylinders along the forward portions thereof and adapted to urge the plungers toward the exit end of the tank at the lower limit of downward travel of the corresponding cylinder.

15. Apparatus of claim 13 wherein the restraining members are formed of a flexible material having a reflexive curve in its unstressed condition, the mounting of the restraining members being disposed so as to avoid entanglement between them when the plungers are raised from their lower limits of travel.

16. Automated laundry apparatus, which comprises:

at least one tank adapted for containing a liquid and articles to be laundered;

a plurality of plungers movable relative to the tank for processing articles within the tank, said plungers comprising a piston, a cylinder encasing said piston and axially movable relative thereto, and means for engaging the cylinders by the pistons to cause movement of the cylinders by movement of the pistons;

means for selectively driving the plungers to process said laundry articles including a plurality of piston rods, each coupled to an associated piston, for driving the plungers in generally vertical reciprocating motion relative to the tank;

auxiliary means for controlling the movement of the plungers separately from the reciprocating motion developed by the driving means, comprising linking members connecting the plungers on the same side of the tank together in a set, and a cable connected to one of the plungers to draw the set of plungers in the water toward the outlet end of the tank in order to drive the laundry articles from the inlet end toward the outlet end of the tank; and control means for controlling the driving means.

17. Apparatus of claim 16 wherein each set of aligned plungers along the longitudinal axis of the tank is linked together, comprising a plurality of cables respectively connected to a plunger of a corresponding set, and actuating means connected to the cables for driving the plungers through the water toward the outlet end of the tank during the time that a set of plungers is passing through the limit of its downward travel in order to move the laundry articles toward the outlet end of the tank.

18. Apparatus of claim 17 further including control means for selectively controlling the actuating means to vary the speed of forward movement of the plungers through the water.

19. Apparatus of claim 17 further including means connected to the plungers of the respective sets to draw the plungers toward the inlet end of the tank during their movement through the limit of upward travel of the plungers.

20. Apparatus of claim 19 wherein said last-mentioned means comprises additional cables connected to corresponding plungers of the respective sets and tension springs connected between the remote ends of the additional cables and the apparatus frame.

21. Automated laundry apparatus, which comprises:

at least one tank adapted for containing a liquid and articles to be laundered and including a transverse partition dividing the tank into first and second sections;

a plurality of plungers movable relative to the tank for processing articles within the tank, said plungers comprising a piston, a cylinder encasing said piston and axially movable relative thereto, and means for engaging the cylinders by the pistons to cause movement of the cylinders by movement of the pistons;

means for selectively driving the plungers to process said laundry articles including a plurality of piston rods, each coupled to an associated piston, for driving the plungers in generally vertical reciprocating motion relative to the tank;

auxiliary means for controlling the movement of the plungers separately from the reciprocating motion developed by the driving means and including means for controlling at least one of the plungers to cause laundry articles to be transported over said transverse partition from the first section to the second section; and control means for controlling the driving means.

22. Cleaning apparatus comprising:

a plurality of tanks for holding liquid and articles to be cleaned, each tank having an inlet end at which articles are admitted and an outlet end at which articles are removed;

each tank having a plurality of bi-directional liquid pumping means for forcing liquid through said items alternately in opposite directions, including a plurality of plungers mounted for reciprocal movement in a generally vertical direction;

means for driving the plungers in reciprocating motion toward and away from the bottom of the tank;

the plurality of tanks comprising a first suds tank for washing laundry articles, a second bleach tank following the suds tank for bleaching laundry articles received therefrom, and a third rinse tank following the bleach tank for rinsing laundry articles received therefrom;

each of the tanks including at its exit end a power-driven conveyor means for transferring laundry articles out of the tank and a roller pivotably mounted adjacent the outer end of the exit conveyor and arranged to rotate therewith for squeezing liquid out of the laundry articles which are being transported by the conveyor means;

means for stripping laundry articles off the conveyor means to prevent their being transported back onto the tank from which they are transported by the conveyor means; and means for stopping a conveyor means in the event of a laundry article being transported along the conveyor means back toward the tank from which it came.

23. Apparatus of claim 22 wherein the stopping means comprises a cable stretched transversely of the conveyor means along the re-entrant portion thereof in the vicinity of its discharge end for detecting the presence of a laundry article adhering to the re-entrant portion, and a switch coupled to the cable for activation thereby, said switch being coupled in the power circuit of the conveyor means for stopping the conveyor means when the cable is activated.

24. Apparatus of claim 22 further including a sour tank positioned to receive laundry articles from the rinse tank, the sour tank having an exit conveyor and squeeze roller associated therewith, and means for monitoring the pH of the laundry articles as they are transported out of the sour tank.

25. Apparatus of claim 24 wherein the monitoring means includes a receptacle positioned to receive liquid squeezed from articles leaving the sour tank, a pH monitor having a probe inserted in said receptacle, and further including means for introducing chemicals to adjust the pH of the liquid in the sour tank in accordance with the pH detected by the probe.

26. Apparatus of claim 22 wherein each of the first, second and third tanks is provided with an overflow weir mounted along the sides of the tank and communicating with the respective tanks through perforations located at the intended level of liquid in the associated tank, and further including a pump and a conduit connected between the overflow weir of the rinse tank and the suds tank for transporting rinse water to the suds tank.

27. Cleaning apparatus comprising:

at least one tank for holding liquid and articles to be cleaned, the tank having an inlet end at which articles are admitted and an outlet end at which articles are removed;

bi-directional liquid pumping means for forcing liquid through said items alternately in opposite directions, including a plurality of plungers mounted for reciprocal movement in a generally vertical direction, means for driving the plungers in reciprocating motion toward and away from the bottom of the tank, the plungers comprising a piston mounted within a cylinder for axial movement relative thereto, the piston being connected to the driving means by a piston rod;

a perforated plate positioned above the bottom of the tank for limiting the downward travel of the articles as driven by the respective plungers; and means for driving the articles through the tank between the inlet and outlet ends as they are being processed by the bi-directional pumping means, including a pusher plate mounted in the vicinity of the bottom of the tank on the upper side of the perforated plate, and actuator means connected to the pusher plate to selectively drive the pusher plate back and forth along the longitudinal axis of the tank, the pusher plate having a plurality of movable blade members adapted to engage the articles when the pusher plate moves in the direction of the outlet end and to disengage the articles when the pusher plate moves in the direction of the inlet end, the movable blade members comprising a plurality of flexible blades extending generally transversely of the pusher plate and mounted thereto along one edge.

28. Cleaning apparatus comprising:

at least one tank for holding liquid and articles to be cleaned, the tank having an inlet end at which articles are admitted and an outlet end at which articles are removed;

bi-directional liquid pumping means for forcing liquid through said items alternately in opposite directions, including a plurality of plungers mounted for reciprocal movement in a generally vertical direction, means for driving the plungers in reciprocating motion toward and away from the bottom of the tank, the plungers comprising a piston mounted within a cylinder for axial movement relative thereto, the piston being connected to the driving means by a piston rod;

a perforated plate positioned above the bottom of the tank for limiting the downward travel of the articles as driven by the respective plungers; and means for driving the articles through the tank between the inlet and outlet ends as they are being processed by the bi-directional pumping means, including a pusher plate mounted in the vicinity of the bottom of the tank on the upper side of the perforated plate, and actuator means connected to the pusher plate to selectively drive the pusher plate back and forth along the longitudinal axis of the tank, the pusher plate having a plurality of movable blade members adapted to engage the articles when the pusher plate moves in the direction of the outlet end and to disengage the articles when the pusher plate moves in the direction of the inlet end, the movable blade members comprising a plurality of transversely aligned blades pivotably mounted to the pusher plate on the upper side thereof.

* * * * *